US007023136B2

(12) United States Patent
Hibino et al.

(10) Patent No.: US 7,023,136 B2
(45) Date of Patent: Apr. 4, 2006

(54) GAS DISCHARGE PANEL AND METHOD OF PRODUCTION OF A GAS DISCHARGE PANEL

(75) Inventors: Junichi Hibino, Neyagawa (JP); Yoshiki Sasaki, Shijounawate (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/621,023

(22) Filed: Jul. 16, 2003

(65) Prior Publication Data

US 2004/0085021 A1 May 6, 2004

Related U.S. Application Data

(62) Division of application No. 09/868,354, filed as application No. PCT/JP00/07224 on Oct. 18, 2000, now Pat. No. 6,692,325.

(30) Foreign Application Priority Data

Oct. 19, 1999 (JP) ..... 11-296326

(51) Int. Cl.
*H01J 17/49* (2006.01)
*H01J 9/00* (2006.01)

(52) U.S. Cl. ..... 313/582; 313/586; 313/587; 313/292; 445/24; 445/25

(58) Field of Classification Search ..... 313/582
See application file for complete search history.

(56) References Cited

U.S. PATENT DOCUMENTS 5,385,499 A 1/1995 Ogawa et al.
5,742,122 A 4/1998 Amemiya et al.
5,770,921 A 6/1998 Aoki et al.
5,892,492 A * 4/1999 Osawa et al. ..... 345/60
6,252,353 B1 * 6/2001 Ha et al. ..... 313/582
6,369,501 B1 * 4/2002 Aoki et al. ..... 313/486
6,538,380 B1 * 3/2003 Kanagu et al. ..... 313/582

FOREIGN PATENT DOCUMENTS

JP 5273672 A 6/1977
JP 60-107233 * 6/1985
JP 60107233 A 6/1985
JP 63155528 A 6/1988
JP 01065743 A 3/1989
JP 01175146 A 7/1989
JP 1183029 A 7/1989
JP 3233829 A 10/1991
JP 479126 A 3/1992
JP 495331 A 3/1992
JP 5-205640 8/1993
JP 06231731 A 8/1994
JP 895239 A 4/1996
JP 8-250029 9/1996

(Continued)

*Primary Examiner*—Mariceli Santiago

(57) ABSTRACT

The present invention provides a gas discharge panel on which color images are accurately displayed and which is easy to manufacture. The first and the second substrates face each other across an interval, forming a discharge space in between, which is filled with a discharge gas. Pairs of electrodes for sustaining discharge are provided on at least one of the two substrates, and phosphor layers are formed on the first substrate, arranged along the electrode pairs to form a matrix of discharge cells. An image is displayed by selectively illuminating discharge cells. Gap members having a given shape are provided between the first and second substrates at locations corresponding to the boundaries between discharge cells.

27 Claims, 16 Drawing Sheets

FOREIGN PATENT DOCUMENTS

| | | | |
|---|---|---|---|
| JP | 08-250030 | | 9/1996 |
| JP | 8250030 | A | 9/1996 |
| JP | 10149773 | A | 6/1998 |
| JP | 10302645 | A | 11/1998 |
| JP | 11-185628 | | 7/1999 |
| JP | 11185628 | A | 7/1999 |

* cited by examiner

GAS DISCHARGE PANEL AND METHOD OF PRODUCTION OF A GAS DISCHARGE PANEL

This is a divisional application of U.S. Ser. No. 09/868,354, filed Jun. 15, 2001, now U.S. Pat. No. 6,692,325, which is a national stage application under 35 U.S.C. 371 of PCT/JP00/07224, filed Oct. 18, 2000.

TECHNICAL FIELD

The present invention relates to a gas discharge panel which is used for display of images with a computer, television or other device, and a method of production for such a panel. More particularly, the present invention relates to a gas discharge panel which has discharge cells arranged in a matrix layout.

BACKGROUND ART

Recently, gas discharge panels have received attention as a flat-type display for computers, televisions, and other such devices.

Gas discharge panels are categorized broadly as direct-current type (DC type) or alternating-current type (AC type), and at present the AC type, which is suitable for large screens, is the mainstream choice.

In an AC-type gas discharge panel, a discharge cell is illuminated by applying an alternating current pulse to an electrode, which is coated with a dielectric layer to maintain discharge. Two kinds are known, a surface discharge type, which has sustaining electrode pairs arranged in parallel on the front panel side, and an opposed discharge type, which has sustaining electrode pairs arranged in opposition to each other on the front panel and back panel.

FIG. 15 shows an example of a conventional AC plane discharge type gas discharge panel.

This gas discharge panel has a front panel 110 and a back panel arranged opposite each other, sealed around the outer edge with a sealing material composed of low-melting glass to form the gas discharge space. The airtight space 104 formed between the two substrates is filled with an inert gas (a mixture of helium and xenon) at a pressure of about 300 Torr to 500 Torr (40 kPa to 66.5 kPa).

The front panel 110 has display electrode pairs 112*a*, 112*b*, formed on the opposing face (the side facing the back panel), and has a dielectric layer 113, composed of dielectric glass, and a protective layer 114, composed of MgO, formed as a coating over the electrodes.

The back panel 120 has address electrodes 122 patterned on the opposing face (the side facing the front panel), and has a back dielectric layer 123 formed as a coating over the electrodes. Barrier ribs 124 are formed on top of the back dielectric layer 123, and RGB phosphor layers 131 are formed between adjacent barrier ribs 124.

The space 140 delimited by the barrier ribs 124 becomes the light-emitting area (discharge cells), and a phosphor layer is applied to each discharge cell. The barrier ribs 124 and address electrodes 122 are formed in the same direction, and the display electrode pairs 112*a*, 112*b*, are perpendicular to the address electrodes 122.

In this gas discharge panel, after applying an address pulse between the address electrode 122 and the display electrode 112*a*, based on the image data to be displayed, applies a sustaining pulse to the pair formed by the display electrode 112*a* and display electrode 112*b*, thereby selectively causing a sustaining discharge in the discharge cell. In the discharge cell subject to sustaining discharge, ultraviolet rays are produced, visible light is generated and emitted from the RGB-colored phosphor layers 131, and an image is displayed.

Here, the barrier ribs 124 divide the discharge space into discharge cells, preventing cross-talk (the phenomenon of discharge mixing across the interface of discharge cells).

Since the filling pressure of discharge gas is usually lower than atmospheric pressure, the front glass substrate 111 and back glass substrate 121 are pressed inward by atmospheric pressure. Here, the barrier ribs 124 act as a spacer, maintaining the space between the two substrates, with the peaks of the barrier ribs contacting the inner surface of the front panel 110.

The following describes a production method for the above gas discharge panel.

For the front panel 110, display electrodes 112*a*, 112*b*, are formed on the front glass substrate 111, a dielectric layer 113 is formed by applying and baking a layer of dielectric glass covering the electrodes, and a protective layer 114 is formed by EB evaporation of MgO over the dielectric layer 113.

For the back panel 120, address electrodes 122 are formed on the back glass substrate 121, the back dielectric layer 123 is formed covering the electrodes, and barrier ribs 124 are formed on top of the back dielectric layer 123.

The barrier ribs 124 may be, for example, formed on the surface of the back dielectric layer 123, then coated with resist. Next, the resist coating may be patterned in stripes, the unnecessary portion of barrier rib material removed by sand blasting, and the coating then baked.

Next, between barrier ribs 124, a phosphor paste is potted by printing or other method and baked to form a phosphor layer 131. This completes production of the back panel 120.

The front panel 110 and back panel 120, produced as described above, have a low-melting glass applied as a sealing material around their outer edges, are stacked and sealed by baking, then evacuated and the space between the two panels is filled with an inert gas, completing production of the gas discharge panel.

In this gas discharge panel, it is desirable for color images to be displayed accurately, and for production cost to be low.

It should be noted that the illumination strength of each discharge cell is affected by the shape of the cell. In order to accurately display color images, it is necessary for the discharge cells which are arranged in a matrix to have a uniform shape. This means that it is necessary for the barrier ribs to have uniform height and width. However, if baking occurs after the barrier rib material is applied and coated, the coating will shrink during baking. This causes difficulty in maintaining a uniform height of the barrier ribs and reduces yield. This in turn increases the production cost of gas discharge panels.

OBJECTS AND SUMMARY OF INVENTION

It is therefore an object of the present invention to provide a gas discharge panel which has precise color display and is easily manufactured.

To this end, the gas discharge panel has a first and a second substrate facing each other with a space in between, the space filled with discharge gas to form a discharge space. At least one of the first and second substrates has groups of electrode pairs for sustaining discharge arranged on its surface. The first substrate has phosphor layers arranged on it, such that a plurality of discharge cells is formed in a matrix pattern along the groups of electrode pairs. A gas discharge panel which displays images by selectively illuminating a plurality of discharge cells, incorporates gap members of a certain shape between the first and second substrates, in areas corresponding to the borders between discharge cells, except for the center of the discharge cell. Here, a certain shape means the gap members have a particular shape, such as spherical or rod-shaped, and their shape does not change over the process of panel production, i.e., the gap members do not deform during baking as a paste material does.

According to the present invention, even without forming barrier ribs between the front panel and back panel, the spacing (gap) between the substrates can be precisely prescribed. Also, since the gap members are not placed in the central area of the discharge cells, the gap members do not hinder discharge, and the panel is resistant to discharge failure.

Therefore, it is easier to produce a gas discharge panel which is capable of high-precision image display, at a lower cost than heretofore.

This type of gas discharge panel can be realized through the following processes: (a) a process for arranging a phosphor layer, which corresponds to the illumination color of the discharge cell, in the desired place on one substrate; (b) a process for affixing gap members of a certain shape on one substrate in a position which corresponds to the border region between discharge cells; and (c) a process for stacking the second substrate on the substrate with the gap members affixed and joining the two substrates.

Here, when forming phosphor layers corresponding to the illumination color of each discharge cell in this way without forming barrier ribs, the conventional method of applying a phosphor paste is prone to cause mixing of colors between adjacent phosphor layers. However, by using a method such as pasting a film containing the phosphor element on to the substrate and patterning, it is possible to successfully form phosphor layers on the substrate, which correspond to the illumination color of each discharge cell.

It is common to use a material such as glass beads to form the gap members, but in this case it is impossible to divide the discharge cells as with barrier ribs, tending to create the problem of cross-talk. Then, when cross-talk occurs, the illumination color of one discharge cell mixes with the illumination color of an adjacent discharge cell, causing a reduction in illumination color quality.

In contrast, cross-talk can be prevented if the groups of electrode pairs and their surrounding structures are arranged such that discharge occurs primarily towards the center of each discharge cell, away from the edges of the discharge cells.

The method of simply arranging gap members on one substrate and joining it with another substrate creates a tendency to have gap members in the center of the discharge cells. The gap members in the center of the discharge cells creates a problem of hindering discharge.

Here, a scheme is necessary to arrange the gap members in the areas of the substrate which correspond to the edges of the discharge cells, and avoid the central areas.

To this end, effective techniques include, for example, forming an adhesive layer in advance in the areas corresponding to edges, or reducing the thickness of the phosphor layer in the areas corresponding to edges.

The stated objective is achieved also by setting filling pressure of the discharge gas in proximity to atmospheric pressure (within a range of 80% to 120% of atmospheric pressure).

That is, setting filling pressure of the discharge gas in proximity to atmospheric pressure avoids influence of atmospheric pressure on the substrates. This means that in the display area, even in an area which is not in contact (this is an area which is not in contact across a plurality of cells in the vertical or horizontal direction, implying a somewhat broad area) across a plurality of discharge cells in two dimensions, the proper gap can be maintained between the two substrates.

By this method, even with a very small amount of distributed gap members, the gap between the substrates can be properly maintained, simplifying production of gas discharge panels compared to conventional methods. Also, it is possible to maintain the proper gap between the two substrates without any gap members in the image display area at all.

The stated objective is achieved also in production of gas discharge panels by using (a) a method of mixing gap members in when forming the phosphor layer, and (b) a method of mixing gap members in when forming the dielectric layer. These methods allow the space between the front panel and back panel to be precisely prescribed, and, since it is not necessary to form barrier ribs, also allow the stated objective to be achieved.

PREFFERED EMBODIMENTS OF THE INVENTION

Embodiment 1

Figure 1:
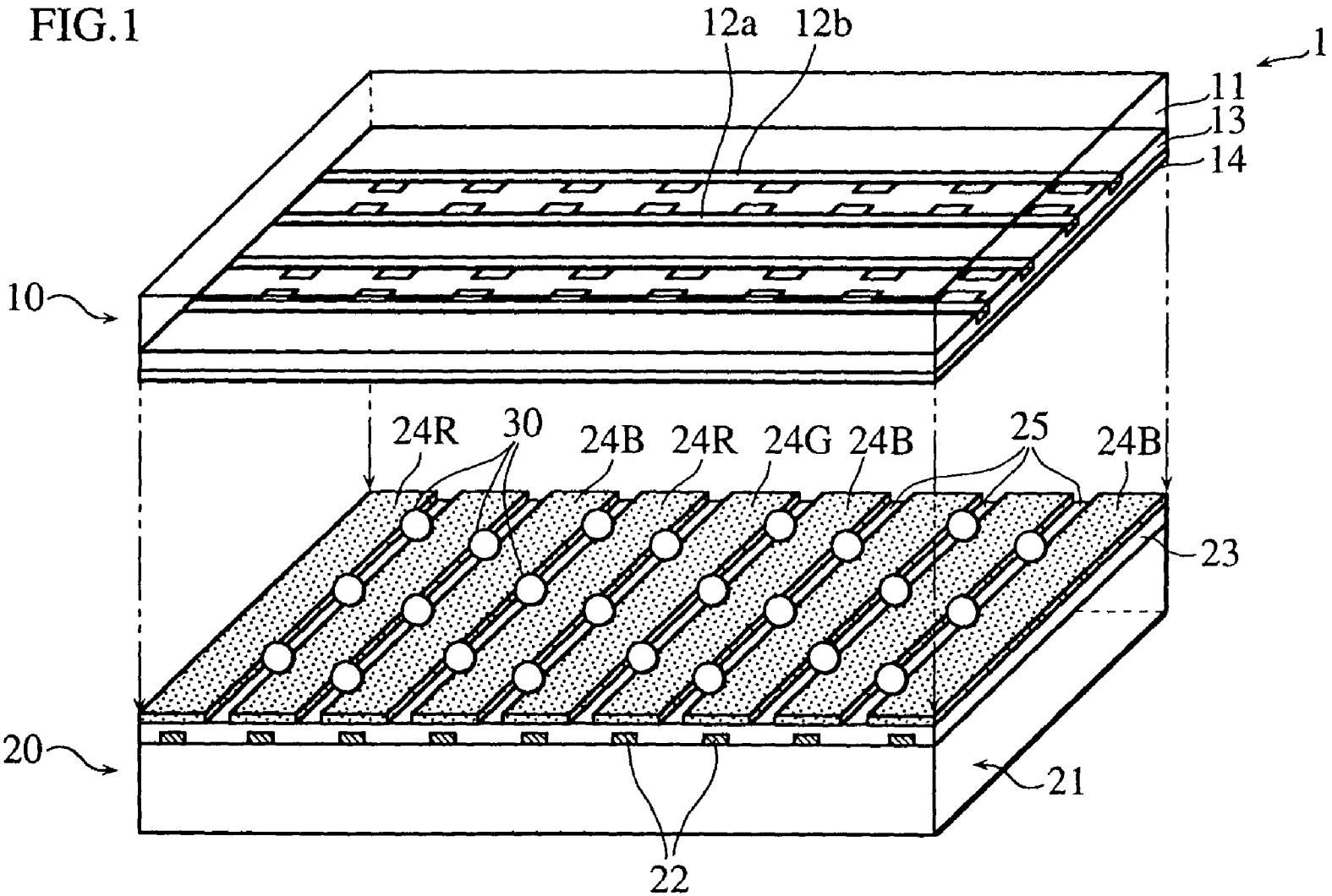
FIG. 1 is an isometric exploded view of a gas discharge panel according to the first embodiment of the present invention.
Figure 2:
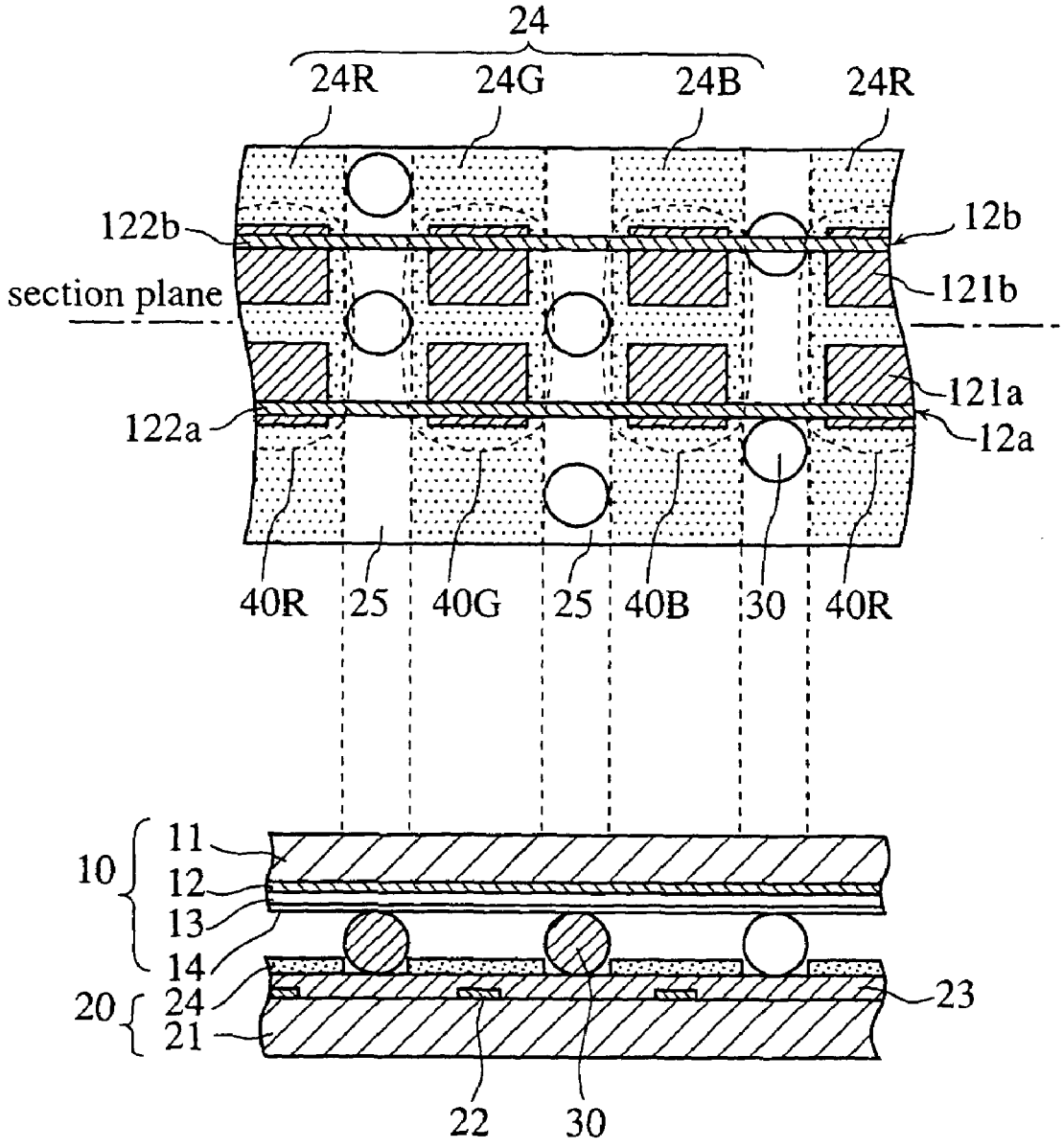
FIG. 2 is a partial top view and a partial cross-section of the gas discharge panel of FIG. 1.

FIG. 1 is an isometric exploded view of a gas discharge panel according to the first embodiment of the present invention, and FIG. 2 is a partial top view and a partial cross-section of the same gas discharge panel.

The following explains the structure of a gas discharge panel according to this embodiment, with reference to the drawings.

Gas discharge panel 1 is formed by a front panel 10 and a back panel 20, joined in parallel across a plurality of gap members 30 (a plurality of glass beads). The two panels 10, 20 are sealed around their outer edges with a sealing material (not shown) composed of low-melting glass, to form a gas discharge space. The gas discharge space is filled with an inert gas (e.g., a mixture of helium and xenon) at a pressure of about 300 Torr to 500 Torr (40 kPa to 66.5 kPa).

The front panel 10 has display electrode pairs 12*a*–12*b* formed in a stripe pattern on the interior side of the front glass substrate 11. A dielectric layer 13 composed of dielectric glass and a protective layer 14 composed of MgO form a coating over the entire surface of the front glass substrate 11, covering the display electrodes 12.

Each display electrode 12*a*–12*b* has a layered structure, formed by a transparent electrode 121*a*, 121*b* composed of a thin membrane of ITO or other metallic oxide, covered by a bus electrode 122*a*, 122*b* composed a thick film of silver or other metal. As described below, the transparent electrodes 121*a*, 121*b* have a particular shape.

The back panel 20 has address electrodes 22 formed in a stripe pattern on the interior side of the back glass substrate 21. A back dielectric layer 23 forms a coating over the address electrodes 22, and phosphor layers 24 of each RGB color are formed in a stripe pattern over the address electrodes 22 on top of the back dielectric layer 23.

Display electrode pairs 12*a*–12*b* are arranged perpendicular to the address electrodes 22, and discharge occurs in the area of the discharge space centered between the intersection of the display electrode pairs 12*a*–12*b* and the address electrodes 22.

The phosphor layer 24 of each color R,G,B, faces a discharge cell 40, and three discharge cells 40R, 40G, 40B (shown by broken line in FIG. 2) along a display electrode pair 12*a*–12*b* forms one pixel.

Adjacent phosphor layers 24 are separated by a space where no phosphor is applied (blank area 25). Gap members 30 (glass beads) are situated between the front panel 10 and back panel 20, distributed along the blank area 25.

That is, the gap members 30 are situated between and in contact with the protective layer 14 and the back dielectric layer 23, thereby determining the gap between the front panel 10 and back panel 20.

The gap members 30 are, in principle, of spherical or other regular form, and composed of a material which has some level of heat-resistance to avoid deformation by heat during the production process of the gas discharge panel. Silica material of spherical form is one specific example.

Figure 3:
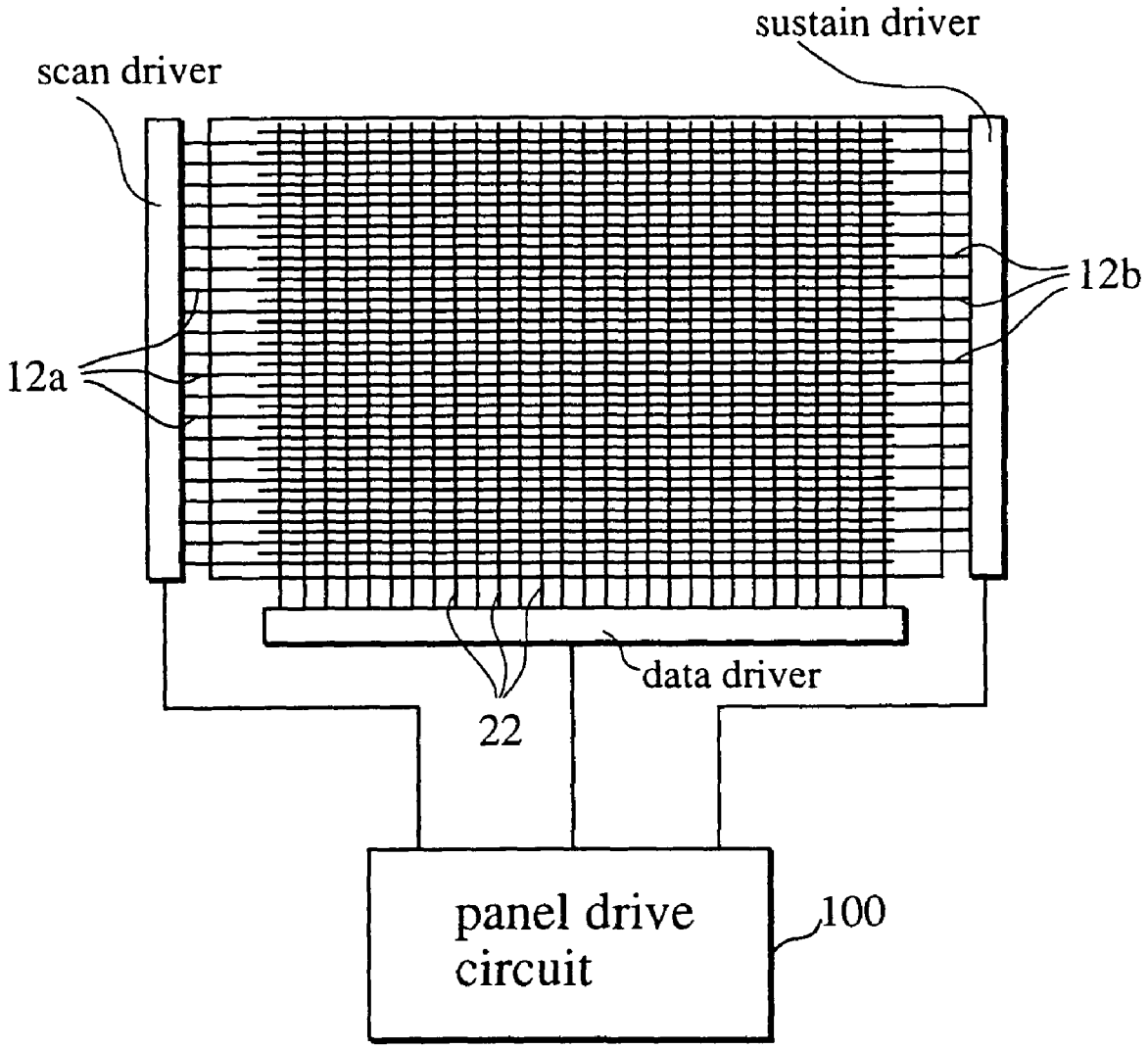
FIG. 3 depicts a display device, comprising the gas discharge panel of FIG. 1 with a driver and driving circuit connected.
Figure 4A:
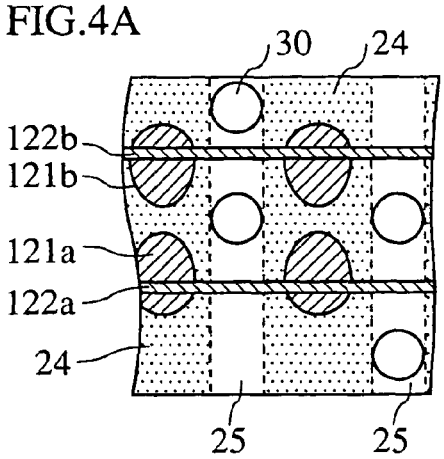
FIG. 4 shows a modification example of transparent electrode shapes of the gas discharge panel of FIG. 1.
Figure 4B:
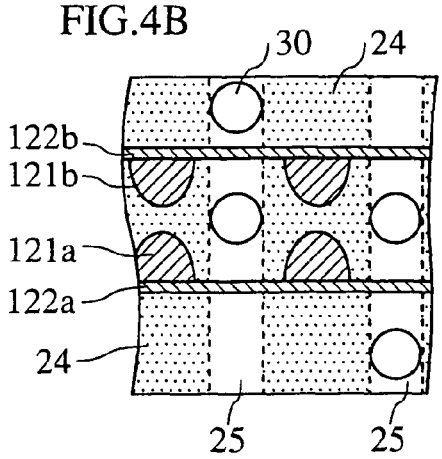
Figure 4C:
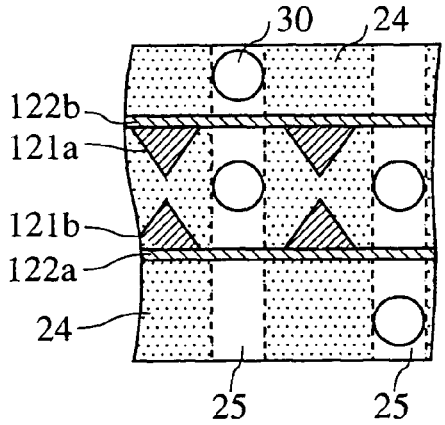
Figure 4D:
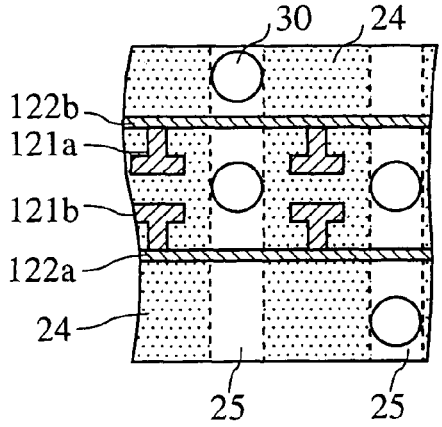
Figure 4E:
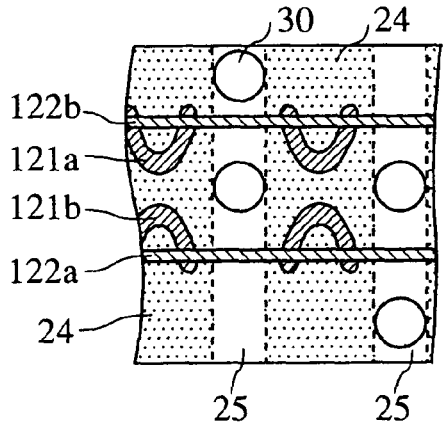
Figure 4F:
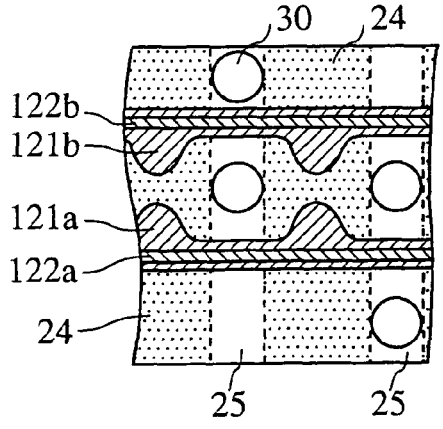

A driver and driving circuit 100 as shown in FIG. 3 is connected to a gas discharge panel 1 of the above structure, and operated to display image data. An address pulse is applied to the address electrode 22 and display electrode 12*a*, and a sustaining pulse is applied to the display electrode pair 12*a*–12*b*, causing a sustaining discharge in the discharge cell chosen in correspondence to the image to be displayed. Then, ultraviolet rays are emitted from the discharge cell 40R, 40G, 40B where discharge occurred. The phosphor layers 24R, 24G, 24B are excited by the ultraviolet rays and emit visible light, causing display of a color image.

Regarding Shape and Operation of Display Electrodes

In the gas discharge panel 1, in the center of each discharge cell on each of the pair of a display electrode 12*a* and display electrode 12*b*, are situated transparent electrodes 121*a*, 121*b*, protruding towards each other in island shapes. Thereby, the space between the display electrode 12*a* and display electrode 12*b* of each pair is smaller at the center of the discharge cell (the center of the phosphor layer 24) than at the border region (i.e., the blank area 25 formed between phosphor layers 24) between adjacent cells. Therefore, when a pulse is applied to the display electrode pair 12*a*–12*b*, discharge occurs primarily in the center of the discharge cell, where the space (discharge gap) is small.

In FIG. 2, the transparent electrodes 121*a*, 121*b* are shown as rectangular island shapes, but, as shown in FIG. 4(*a*) through (*e*), they could also be egg-shaped (a), semi-circular (b), triangular (c), T-shaped (d) or crescent-shaped (e), and still produce discharge primarily in the center of the discharge cell in similar fashion.

As shown in FIG. 4(*f*), the transparent electrodes 121*a*, 121*b* may also be band-shaped, instead of island-shaped, with protrusions in the center of the discharge cell, and still produce discharge primarily in the center of the discharge cell in similar fashion.

The transparent electrodes must not necessarily be formed as two separate parts, on display electrodes 12*a* and 12*b*. Forming only one transparent electrode 121*a* as described above on one display electrode 12*a*, for example, will produce discharge primarily in the center of the discharge cell in similar fashion also.

Display electrodes 12*a* and 12*b* may be formed by all metallic electrodes, and as long as the metallic electrodes have protrusions formed in the center of each discharge cell, will produce discharge primarily in the center of the discharge cell in similar fashion.

In this embodiment, protrusions may be formed in the center of the discharge cell on the bus electrode itself, without using transparent electrodes, and still produce discharge primarily in the center of the discharge cell.

Explanation of Gas Discharge Panel's Effectiveness

The gas discharge panel 1 described above has gap members 30 which have a regular form and does not suffer heat-deformation in the production process. This allows the spacing between the front panel 10 and back panel 20 to be precisely regulated. This, in turn, ensures the correct height of the discharge space in each discharge cell. In addition, in production of the gas discharge panel 1, the process of forming barrier ribs can be eliminated, simplifying production.

When there is no barrier rib between adjacent discharge cells, conventionally cross-talk becomes a problem. However, in the case of the gas discharge panel 1 here, the display electrode pair 12*a*–12*b* is formed such that, when, as described above, a sustaining pulse is applied, discharge occurs primarily in the center of the discharge cell. This prevents discharge from spreading to the bordering area, and prevents cross-talk.

Therefore, when driven, it is possible to reduce image instability and provide a high-quality image display.

Modification Example of a Structure for Producing Discharge Primarily in the Center of the Discharge Cell In the examples of FIGS. 2 and 4 above, the shape of the display electrodes was controlled in order to cause discharge primarily in the center of the discharge cell. However, as described below, even if the display electrode is a simple band-shape, it is also possible to produce discharge primarily in the center of the discharge cell by controlling the surrounding structure, e.g., by controlling the shape of the dielectric layer 13 or the protective layer 14.

For example, instead of producing a dielectric layer 13 with uniform thickness across the entire surface, discharge may be focused in the center of the discharge cell by increasing the thickness of the dielectric layer 13 towards the edges of the discharge cell and decreasing the thickness towards the center of the discharge cell (e.g., by layering the dielectric layer while patterning, producing fewer layers in the area facing the phosphor layer 24 and more layers in the area facing the blank area 25). This method makes it possible to produce discharge primarily in the center of the discharge cell.

Or, instead of forming the protective layer 14 uniformly of MgO across the entire surface of the dielectric layer 13, only the portion of the protective layer 14 towards the center of the discharge cell may be formed of MgO (e.g., by patterning the protective layer, forming a MgO membrane in the area facing the phosphor layer 24 and not forming a MgO membrane in the area facing the blank area 25.). This method also produces discharge primarily in the center of the discharge cell, because secondary electrons are more likely to be released during discharge in the area where a MgO protective layer is formed.

Embodiment 2

Figure 5:
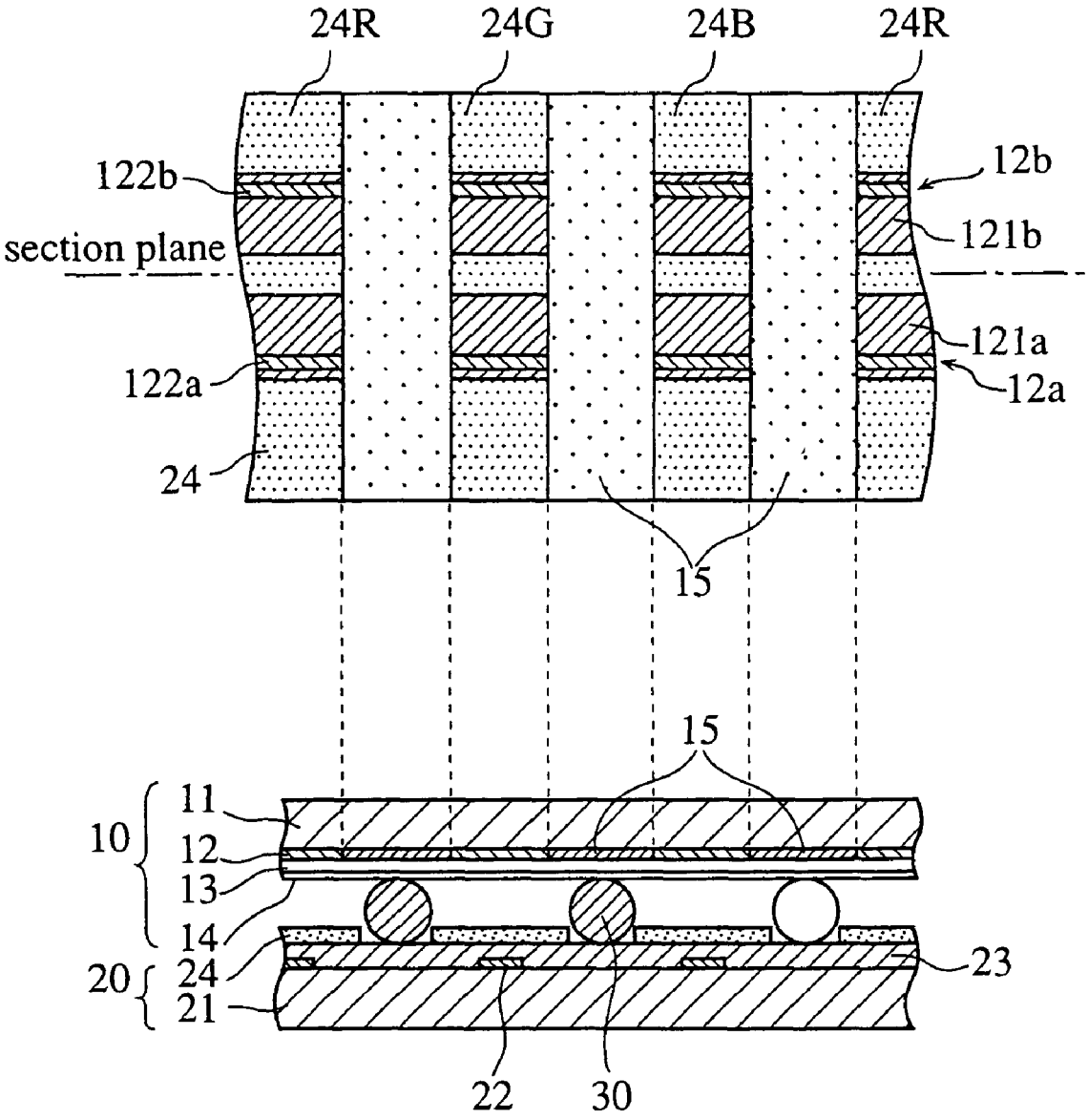
FIG. 5 is an abbreviated partial cross-section of the gas discharge panel according to the second embodiment.
Figure 6A:
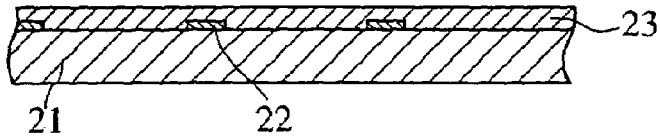
FIGS. 6 to 10 are explanatory diagrams of the production methods according to the first and second embodiments.
Figure 6B:
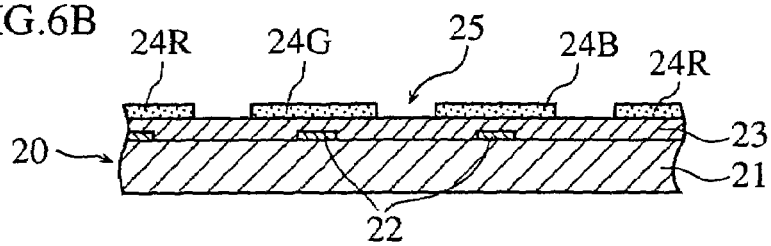
Figure 6C:
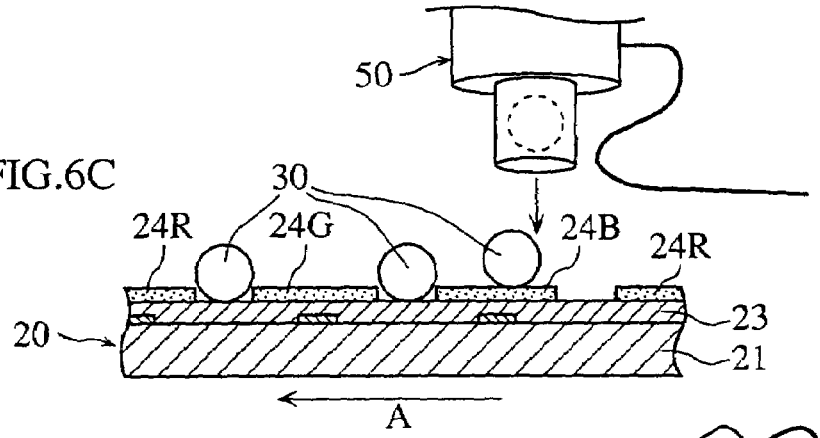
Figure 6D:
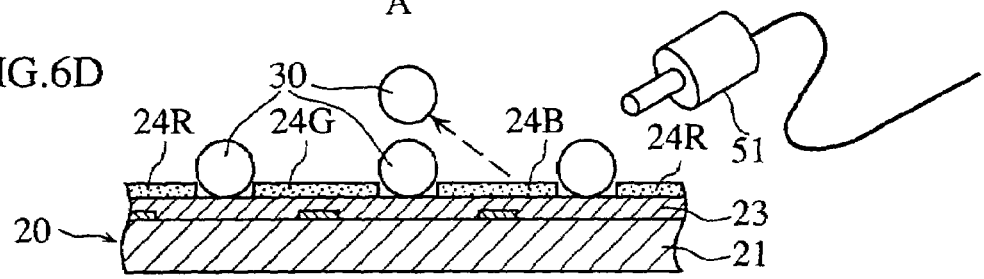
Figure 6E:
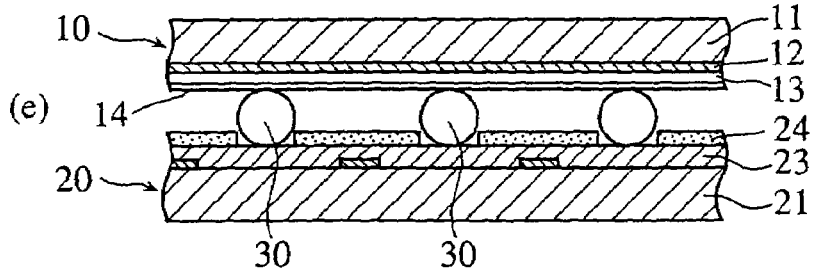
Figure 7A:
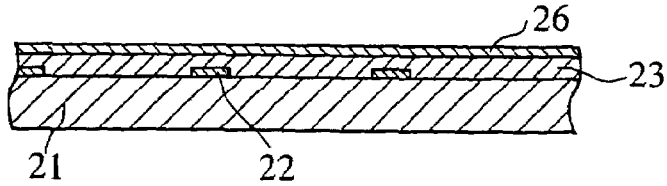
Figure 7B:
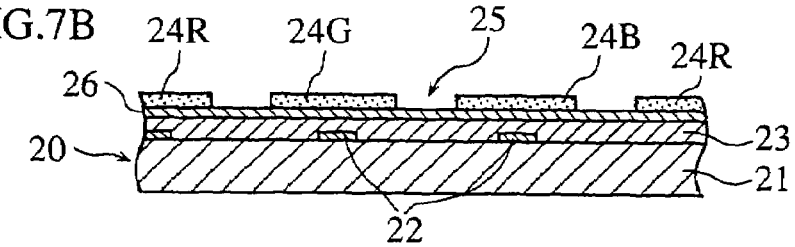
Figure 7C:
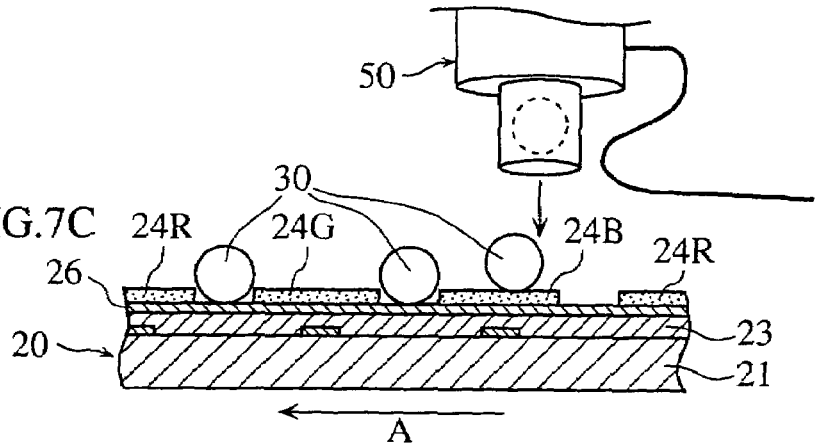
Figure 7D:
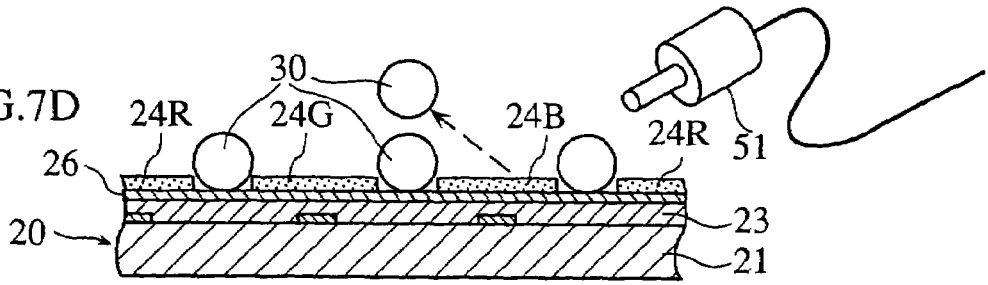
Figure 7E:
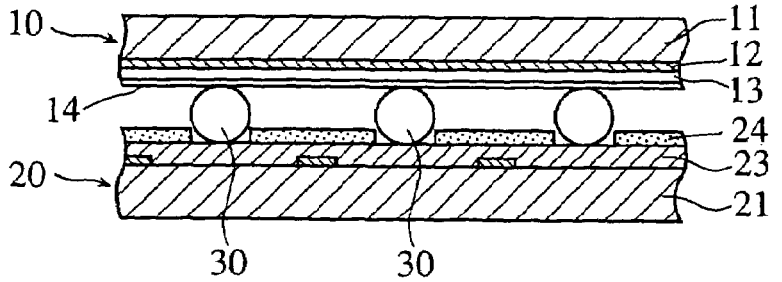
Figure 8A:
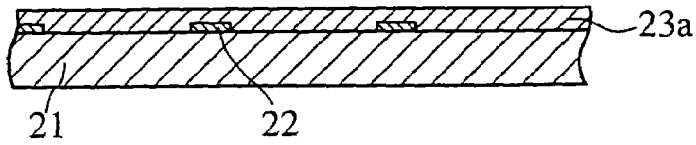
Figure 8B:
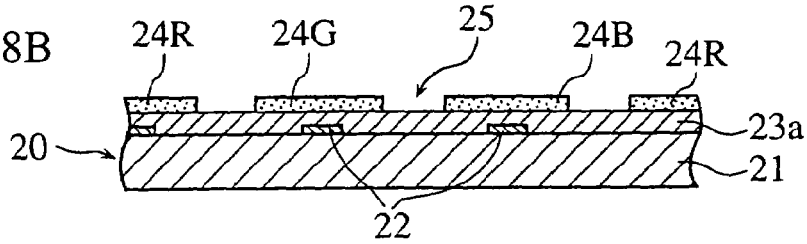
Figure 8C:
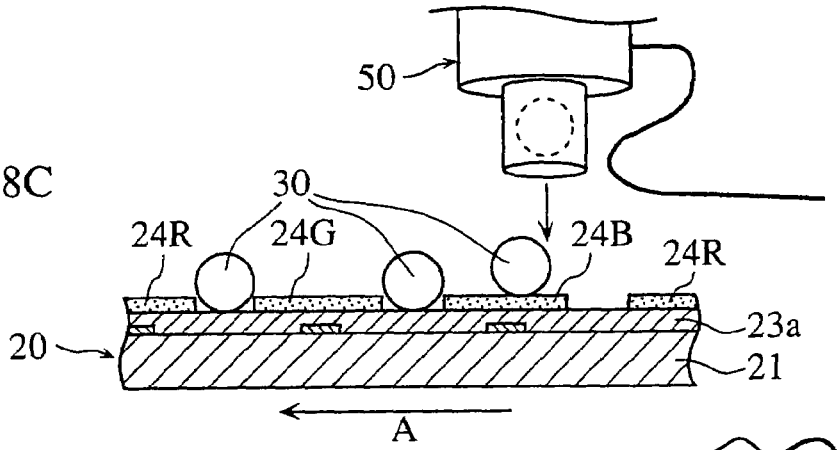
Figure 8D:
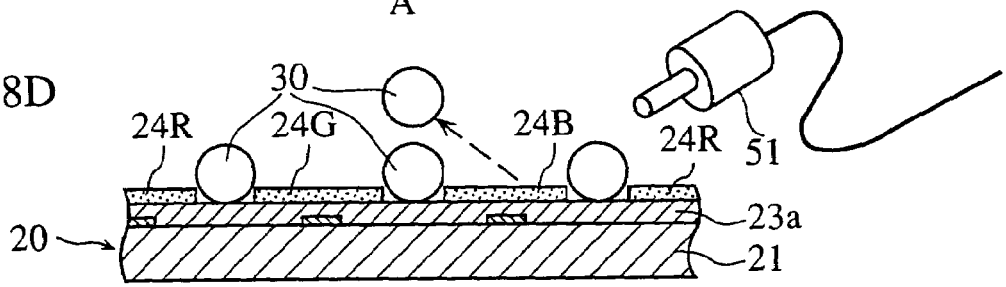
Figure 8E:
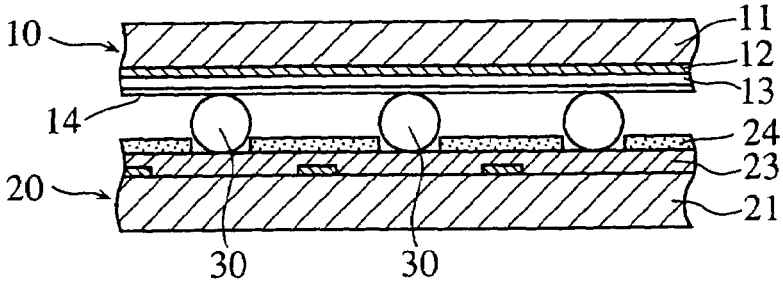
Figure 9A:
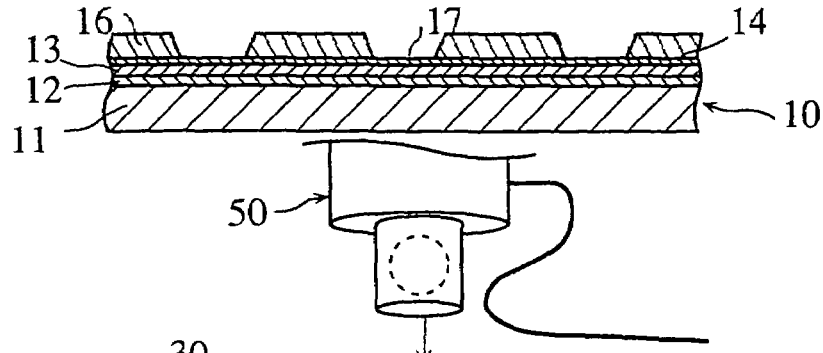
Figure 9B:
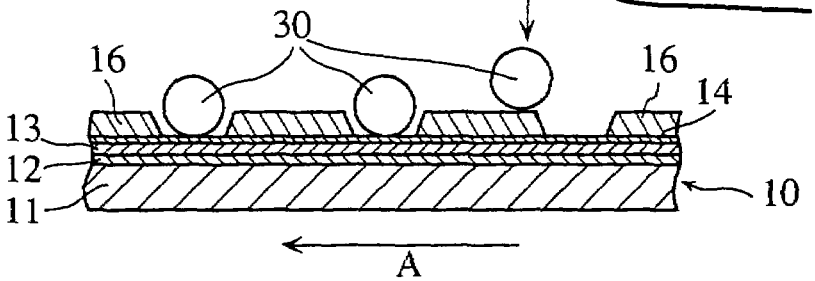
Figure 9C:
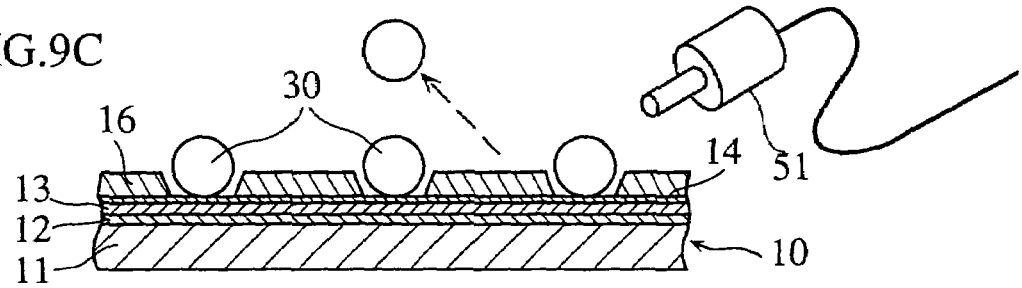
Figure 9D:
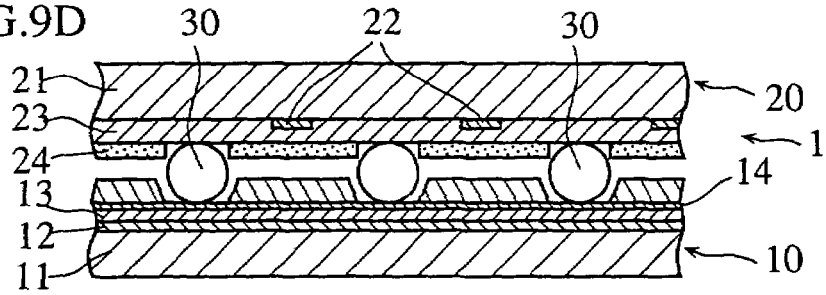
Figure 9E:
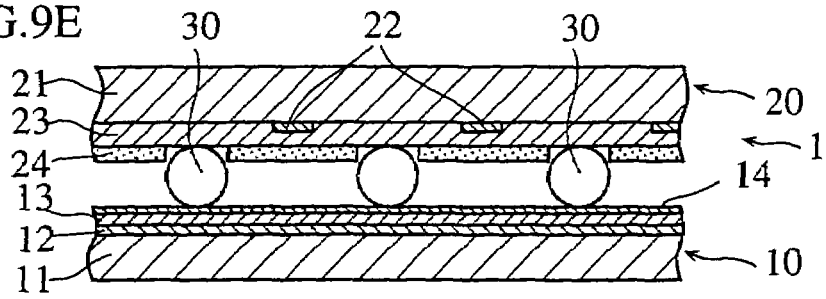
Figure 10A:
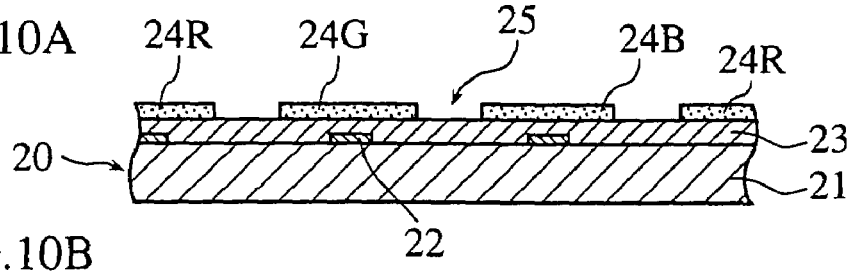
Figure 10B:
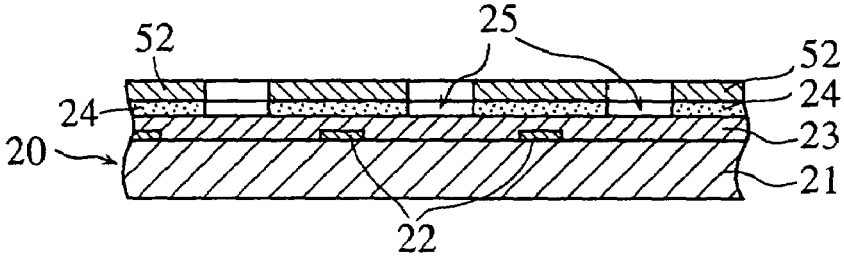
Figure 10C:
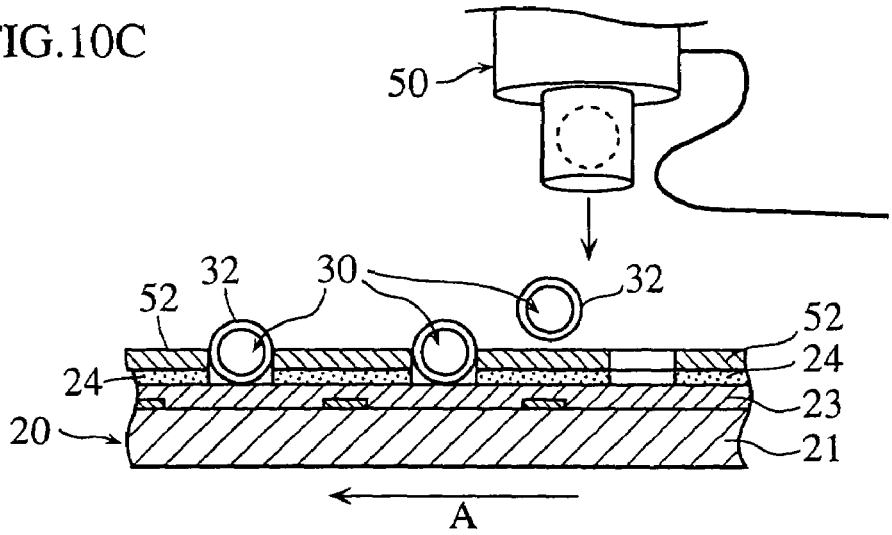
Figure 10D:
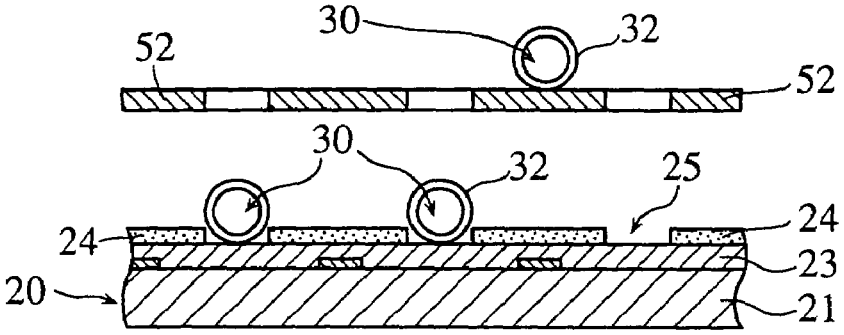

FIG. 5 shows an abbreviated partial cross-section of the gas discharge panel according to the second embodiment. The following explains the structure of a gas discharge panel with reference to this figure.

The gas discharge panel of this embodiment is similar to the gas discharge panel shown in FIG. 1. The differences, as shown in FIG. 5, are the simple line-shape of the display electrode pairs and the formation of a black matrix 15 on the interior surface of the front glass substrate 11 in the area facing the blank area 25 (the space between adjacent phosphor layers 24).

When the display electrode pairs are simple line-shapes, cross-talk is more likely to occur than in the first embodiment. However, because of the black matrix 15, even if cross-talk occurs at the border area of adjacent phosphor layers 24 and causes release of mixed-color light, this light is interrupted by the black matrix 15, so that almost none escapes, controlling loss of picture quality due to color-mixing from cross-talk.

By forming a black matrix 15 as shown in FIG. 5, and controlling the shape of the display electrodes as shown in FIGS. 2 and 4 in the first embodiment, the mixed light interruption benefit of the black matrix 15 and the discharge cross-talk prevention benefit of the designed display electrode shape make it possible to achieve better image quality.

Production Method of the Gas Discharge Panel

The following explains production methods of the gas discharge panel 1 described in the above embodiments, by way of five examples.

EXAMPLE 1

FIG. 6(*a*) to (*d*) are explanatory diagrams of one example production method for the gas discharge panel described in the first and second embodiments.

First, a paste composed of particulate silver, low-melting glass, ethylcellulose resin, and solvent is applied in lines to the surface of the back glass substrate 21 by a printing method. The paste then is baked to form address electrodes 22. Then, a dielectric paste is applied covering the electrodes and baked to form the back dielectric layer 23.

FIG. 6(*a*) shows the back glass substrate 21 with address electrodes 22 and the back dielectric layer 23 formed on it.

Next, a green phosphor film containing acrylic photosensitive resin, acrylic resin, and green phosphor powder is applied across the entire surface of the back dielectric layer 23. The film is then patterned by exposure in lines to harden the photosensitive resin and developing with a sodium carbonate aqueous solution. Next, a red phosphor film and a blue phosphor film are applied and patterned in similar fashion. Then, the phosphor layers are baked to form the red, blue, and green phosphor layers 24R, 24B, 24G, as shown in FIG. 6(*b*). This completes the back panel 20.

Patterning is executed such that a blank area 25 is created between adjacent phosphor layers. It is desirable to have no phosphor material present in the blank area 25, but some may be present.

Next, as gap members 30, spherical beads composed of quartz glass are suspended in isopropyl alcohol and controlled. As shown in FIG. 6(*c*), a sprayer 50 and the back panel 20 are moved in relation to each other (as arrow A in the figure) and this suspension is sprayed from the sprayer to distribute the gap members 30 over the back panel 20.

The gap members 30 distributed in this manner become scattered across the blank area 25 on the back panel and on the phosphor layer 24.

Next, as shown in FIG. 6(*d*), an air gun 51 sprays compressed air on the entire surface of the back panel 20. This removes gap members 30 from the phosphor layer 24, but gap members 30 on the blank area 25 contact the surface of the back dielectric layer 23 and the edge of the phosphor layer 24, and is difficult to remove.

As a result, from this process gap members 30 are left in the blank area 25.

Also, when ratio of the width of the blank area 25 to the width of the gap members 30 (diameter of the glass beads) is at least 50% and no more than 100%, there is a stronger tendency for the gap members 30 to remain in the blank area 25, so a ratio within this range is desirable.

For example, when the diameter of the glass beads is 100 μm, it is desirable to set the width of the blank area 25 in a range of 50 μm to 100 μm.

Next, as shown in FIG. 6(*e*), the back panel 20 with gap members 30 applied has a front panel situated on top, and the outer edge is sealed with a sealing material and filled with discharge gas to complete the gas discharge panel 1.

In the case of the front panel 10, first a thin membrane of transparent electrode material is formed by sputtering or other method, and then the transparent electrodes are formed by patterning by etching by photoresist. Then, silver electrode material is printed and baked to form a bus electrode, which comprises the display electrode pair 12*a*–12*b*. Then, a dielectric paste is applied to cover the surface of the electrodes and baked to form the dielectric layer 13, and MgO is EB vapor deposited thereon to form the protective layer 14 and complete production of the front panel 10.

When, as in the second embodiment, a black matrix 15 is formed on the front panel 10, a paste containing black pigment (an inorganic pigment including transition metals such as iron, chromium, manganese), low-melting glass, and photosensitive resin may be applied and patterned by photolithography on the surface of the front glass substrate 11.

Explanation of Effectiveness

According to the production method described above, because the phosphor layers 24R, 24G, 24B are formed by a dry method using photosensitive film, a gas discharge panel produced by this production method will not suffer color mixing, even without barrier ribs to separate adjacent phosphor layers.

If gap members 30 were situated in the center of a discharge cell, that cell would tend to suffer discharge failure and non-lighting. However, in the case of a gas discharge panel produced using the method described above, there are no gap members 30 on the phosphor layers 24R, 24G, 24B, and gap members 30 are distributed across the blank area 25, preventing discharge failure.

In actual testing, when a gas discharge panel produced according to the above method was compared to a conventional gas discharge panel with barrier ribs as described in the background art above, neither panel showed any non-lighting, and each achieved equivalent illumination characteristics for all colors.

As described here, using the gas discharge panel production method according to this embodiment, production cost can be greatly reduced through elimination of the barrier rib formation process. Furthermore, according to the production method of this embodiment, a gas discharge panel with excellent color display quality can be produced.

Modification Examples of the Present Embodiment

In the above production method, by forming a thick film of acrylic resin or such material on the phosphor layer 24 of the back panel 20 and spreading gap members 30 on top, it is possible to limit more reliably distribution of the gap members to the blank area. In this case, the thick film of acrylic resin or such material will be burned off in the phosphor layer baking process or the sealing material baking process, so as not to remain on the finished gas discharge panel.

Additionally, in the production method above, the phosphor layers are formed using a phosphor film which includes photosensitive resin, patterned by photolithography. However, for example, it is also possible to form the phosphor layers by a method of direct application of phosphor film of each color. Using this dry method, which does not require a solvent, to form the phosphor layers, it is possible to prevent mixing of colors between phosphor layers.

Additionally, in the production method above, the phosphor layers 24 were baked first, followed by distribution of the gap member glass beads. However, the gap members may be distributed without baking, and the front panel 10 joined to the back panel 20, and the gap members may be baked together in the same process with the sealing material.

In this way, by baking the phosphor layers after distribution of the gap members 30, the gap members 30 are fused to the phosphor layers 24 where they contact each other. Therefore, by using this method, it is possible to produce a gas discharge panel whose gap members 30 are joined to its phosphor layers 24.

Additionally, in the production method above, low-melting glass may be applied to the surface of the gap member 30 glass beads before baking. In this case, when the sealing material is baked in the sealing process, the low-melting glass on the surface of the glass beads will melt, thereby joining the gap members 30 to the front panel 10 and the back panel 20. Therefore, by this method, a gas discharge panel can be produced whose front panel 10 and back panel 20 are joined via the gap members 30. In this case, the gap between the two panels 10, 20 can be accurately maintained even with discharge gas filled to higher than atmospheric pressure.

Additionally, in the production method above, compressed air is used to remove gap members 30 from the phosphor layers 24. However, gap members 30 can be removed from the phosphor layers 24 by agitation of the back panel 20 as well.

EXAMPLE 2

FIGS. 7(*a*) through 7(*e*) describe an example of the production method of a gas discharge panel as described in Embodiments 1 and 2.

In the production method of this example, as described in Example 1 (FIG. 6(*a*)), address electrodes 22, which correspond to the back dielectric layer 23, are formed on the back glass substrate, and the back dielectric layer 23 was formed thereon, followed by formation of an adhesive layer 26 on top of the back dielectric layer 23.

FIG. 7(*a*) shows the back dielectric layer 23 with the adhesive layer 26 formed on top.

The adhesive layer 26 is formed of a material which has adhesion, e.g., an adhesive resin such as an epoxy resin. Using a reverse coater, a solution of the epoxy resin and isopropanol is applied and dried to form the adhesive layer 26.

Next, as described in Example 1, the phosphor layers 24R, 24G, 24B are formed (FIG. 7(*b*)), gap members 30 are distributed over the entire surface (FIG. 7(*c*)), compressed air (or vibration) is used to remove gap members from the phosphor layers 24 (FIG. 7(*d*)).

Here, while the surface of the phosphor layers 24 have no adhesion, the adhesive layer 26 is exposed in the blank area 25, so that the gap members 30 applied to the blank area 25 are strongly attached as compared to the case of Example 1.

Therefore, when an airgun 51 blows compressed air to remove gap members 30 from the phosphor layers 24, the gap members 30 located in the blank area 25 are not removed. Hence, it is possible to efficiently remove the gap members 30 from the phosphor layers 24.

Finally, as shown in FIG. 7(*e*), the front panel 10 is stacked on the back panel 20, which has gap members 30 applied to it, the outer edges are sealed with sealing material, and discharge gas is inserted to complete the gas discharge panel 1.

In the sealing process, when the sealing material is baked, resin forming the adhesive layer 26 is decomposed and eliminated, burning off the adhesive layer 26. The adhesive layer 26 does not remain in the completed gas discharge panel 1. Therefore, an adhesive layer 26 can be created by the process described above, without negatively affecting discharge in the finished gas discharge panel.

EXAMPLE 3

FIGS. 8(*a*) through (*e*) describe an example of a production method for the gas discharge panel described in Embodiments 1 and 2.

In this example, first address electrodes 22 are formed on the back glass substrate 21, and a dielectric paste is applied over the electrodes to form an unbaked back dielectric layer 23*a* (FIG. 8(*a*)). Then, without baking this, phosphor layers 24R, 24G, 24B formed on top (FIG. 8(*b*)).

Then, in the same way as Example 1, gap members 30 are distributed over the entire surface (FIG. 8(*c*)), and gap members 30 on the phosphor layers 24 are removed by compressed air (or agitation) (FIG. 8(*d*)).

In the production method of this Example, when gap members 30 are sprayed over the surface, gap members 30 in the blank area 25 are pressed into the unbaked back dielectric layer 23*a*, causing the gap members 30 to be partially buried and fixed.

Therefore, as in the production method of Example 2, when removing gap members 30 from the phosphor layers 24, blowing compressed air from an airgun 51 at high power will not remove gap members located in the blank area 25. This allows gap members 30 to be efficiently removed from the phosphor layers 24.

Finally, as shown in FIG. 8(*e*), the front panel 10 is stacked on the back panel 20, which has gap members 30 applied to it. The two panels 10, 20 are compressed such that the gap between them is uniform, sealed around their outer edges with sealing material and filled with discharge gas. In the sealing process, the unbaked back dielectric layer 23*a* can be baked simultaneously with the sealing material. This baking forms the back dielectric layer 23 to complete the gas discharge panel.

By baking the back dielectric layer 23*a* after distribution of the gap members 30 in this way, the gap members 30 and dielectric layer 23 are fused where they contact each other.

Therefore, in a gas discharge panel produced by the above method, the gap members 30 and the back dielectric layer 23 are joined with part of the gap members 30 buried in the dielectric layer 23.

In the production method of this Embodiment, first the phosphor layers 24 are baked, followed by distribution of the glass bead gap members 30. However, it is also possible to distribute the gap members 30 without first baking the phosphor layers 24, then join the front and back panels 10, 20, and bake the phosphor layers 24 simultaneously in the sealing material baking process.

EXAMPLE 4

FIG. 9 shows an example of a production method for the gas discharge panel described in Embodiments 1 and 2.

In this example production method, first, a thick film 16 is formed in a stripe pattern over the protective layer 14 on the front panel 10. A blank area 17 is formed between adjacent thick films.

The material forming this thick film 16 has properties such that it will be burned off when heat or other energy is applied, with acrylic or other resins used here. The thick film 16 is formed in areas which will be opposite the phosphor layers 24 when the gas discharge panel is finished (i.e., areas corresponding to the center of the discharge cells).

To form the thick film 16, a method of printing a resin paste may be used, or a method of applying a photosensitive resin paste or a photosensitive resin film and patterning by photolithography.

As described in FIG. 6(*c*) for Example 1, gap members 30 (glass beads) are distributed across the entire surface of the front panel 10 (FIG. 9(*b*)), and removed from the thick film 16 by compressed air (or vibration) (FIG. 9(*c*)).

In this way, gap members 30 are disposed in a distribution across the blank area 17 between adjacent thick films 16.

The back panel 20 is produced as described in FIG. 6(*a*), (*b*) for Example 1.

Finally, as shown in FIG. 9(*d*), the back panel 20 is joined to the front panel 10, which has gap members 30 disposed on it. The gap members 30 are caught in the blank area 25 between adjacent phosphor layers 24.

Then, the two panels 10, 20 are sealed around their edges with sealing material. In the sealing process, the thick film 16 is baked simultaneously with the sealing material and burned off, so that no thick film 16 remains after sealing, as shown in FIG. 9(*e*). Then, discharge gas is filled to complete the gas discharge panel 1.

As described here, a gas discharge panel 1 can also be produced by a method of forming the thick film 16, which regulates the locations where gap members 30 are disposed, on the front panel 10, and dispersing gap members 30 over the top.

EXAMPLE 5

FIGS. 10(*a*) to (*d*) show an example of a production method for the gas discharge panel described in Embodiments 1 and 2.

In the production method of this example, first, as shown in FIG. 10(*a*), a back panel 20 is prepared, by forming address electrodes 22 on the back glass substrate 21 and forming a back dielectric layer 23 and phosphor layers 24 on top, as in FIGS. 6(*a*) and (*b*) of Example 1 above. Then, as shown in FIG. 10(*b*), a mask plate 52 with cut-out portions corresponding to the locations of blank areas 25 is placed over the back panel, so that only portions corresponding to phosphor layers 24 are covered. The extent covered by the mask plate 52 is adjusted according to the size of the gap members 30 (diameter of the glass beads), but the center regions of the phosphor layers 24 must be covered.

Next, as described in FIG. 6(*c*) of Example 1, gap members 30 are dispersed across the entire surface of the front panel 10 (FIG. 10(*c*)). However, the surface of the glass beads, which are the gap members 30 to be dispersed, is coated with an adhesive material (e.g., epoxy resin) to form an adhesive layer 31 beforehand.

Then, when the mask plate 52 is removed from the back panel 20, the gap members 30 located in the blank area 25 remain on the back panel 20, and the gap members 30 disposed on the mask plate 52 are removed from the back panel 20.

It is not absolutely necessary to create an adhesive layer 31 on the gap members 30, but an adhesive layer 31 fuses the gap members 30 securely to the blank area 25, and prevents gap members 30 in the blank area 25 from becoming dislodged when the mask plate 52 is removed.

Finally, as described in FIG. 6(*e*) of Example 1, the front panel 10 is joined to the back panel 20, which has gap members 30 disposed on it, and discharge gas is filled to complete the gas discharge panel 1. The adhesive layer 31 is burned off when it is baked with the sealing material during the sealing process, so that it does not remain in the finished gas discharge panel.

Although the example above describes a process in which a mask plate is laid over the surface of the back panel 20 and gap members 30 are dispersed over the mask, the mask plate 52 may be laid over the front panel 10 and gap members 30 are dispersed over it, then, when the mask plate is removed, gap members 30 will be left in areas of the front panel 10 which correspond to the blank areas. Joining the back panel 20 thereto produces a similar gas discharge panel.

Embodiment 3 Non-Spherical Gap Members

In Embodiments 1 and 2 above, spherical glass beads are used for the gap members 30, but the gap members 30 are not limited to spherical forms, as any shape which can regulate the gap between the two panels 10, 20 when disposed in the blank areas is acceptable.

Figure 11:
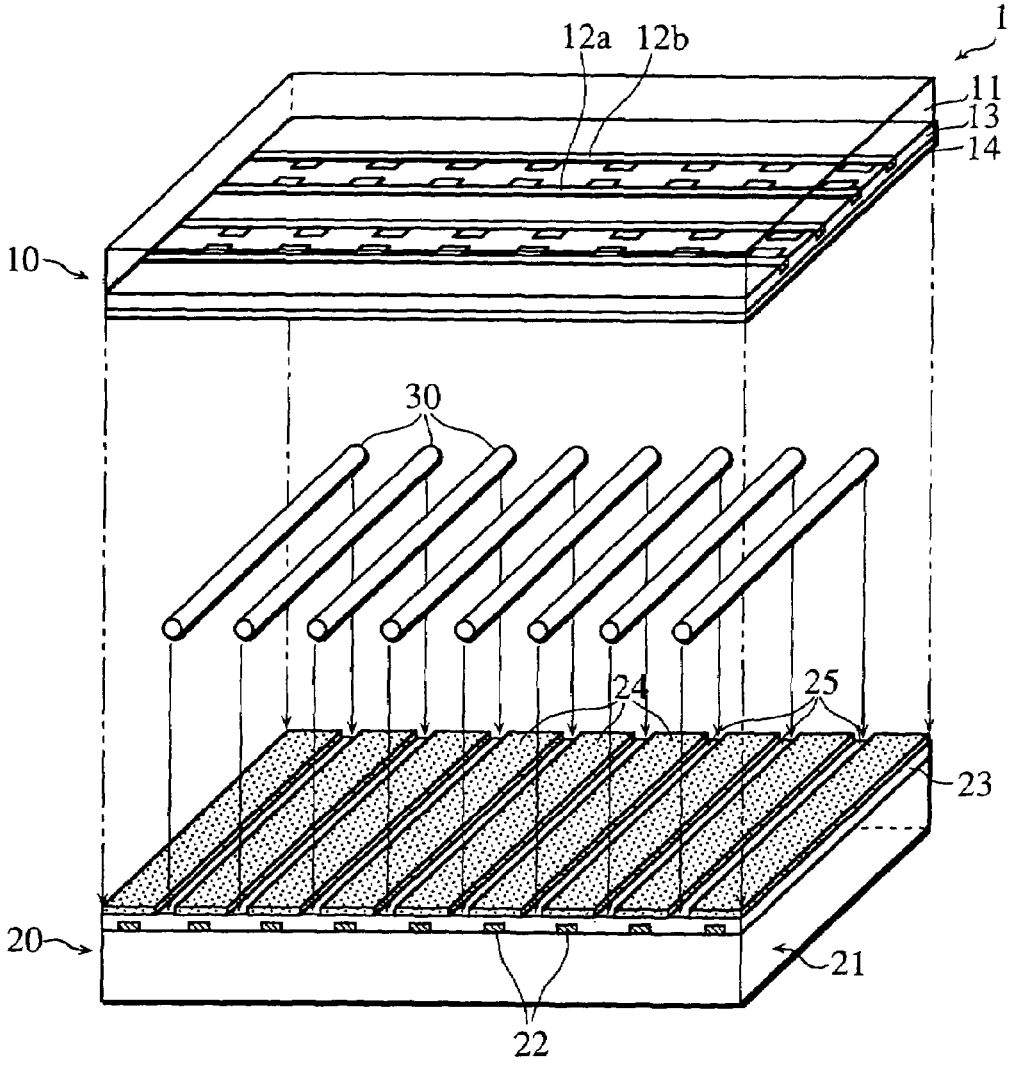
FIGS. 11 and 12 are isometric exploded views of a gas discharge panel according to the third embodiment.

For example, as shown in FIG. 11, instead of glass beads, the same results may be obtained by using rod-shaped gap members 30 composed of fibers such as glass fibers (the fibers may also be hollow tubes), disposed in the blank areas 25.

This sort of rod-like gap members 30, disposed in the blank areas 25, also perform the function of barrier ribs, controlling cross-talk.

It is not absolutely necessary for the rod-like gap members 30 to be placed in each and every blank area 25, but may also be placed at intervals (e.g., in every other blank space).

However, in this case, leakage of light from boundary areas with and without gap members 30 varies, which tends to cause non-uniform illumination. Therefore, in order to maintain image quality, it is desirable to prevent leakage of light from the boundary areas by forming a black matrix in the boundary areas, as described in Embodiment 2.

Figure 12:
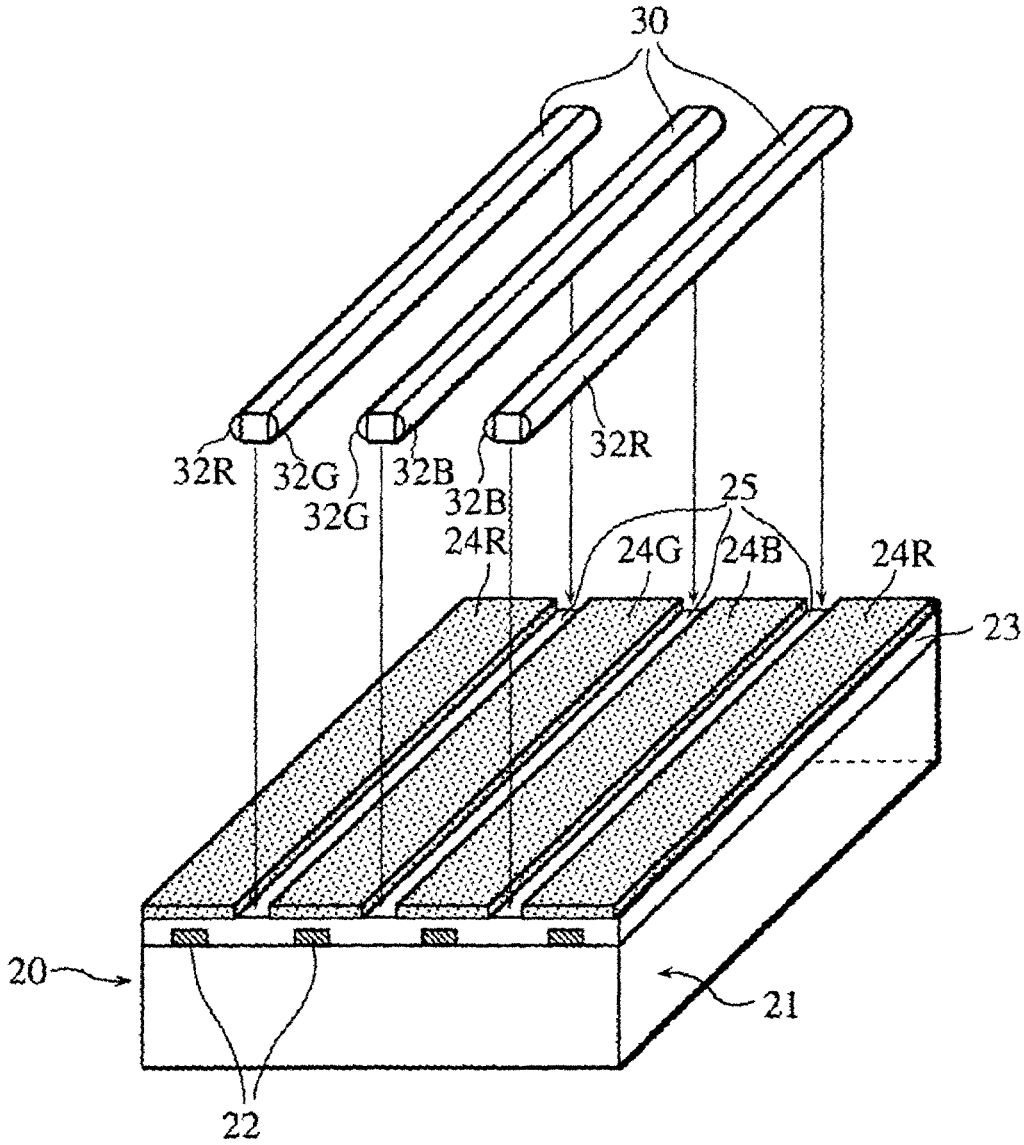

As a shape of rod-like gap members 30 for the blank areas 25, besides the round rod as in FIG. 11, an angular rod, as shown in FIG. 12 may also be used.

Also, the gap member 30 shown in FIG. 12 has a phosphor layer 32 formed on its surface, in the same color as the phosphor layer facing it.

That is, the side of a gap member 30 facing a red phosphor layer 24R is covered with a red phosphor layer 32R, the side of a gap member 30 facing a green phosphor layer 24G is covered with a green phosphor layer 32G, and the side of a gap member 30 facing a blue phosphor layer 24B is covered with a blue phosphor layer 32B.

By also forming phosphor layers 32 on the gap members 30, the discharge space of each discharge cell has phosphor layers 24 and phosphor layers 32 facing it, increasing the illumination efficiency of each discharge cell.

It should be noted here that, while glass beads can be distributed across the blank areas 25 by mixing into a slurry, rod-like gap members 30 cannot, making it necessary to use a method in which the location of the rods is adjusted and fixed.

Embodiment 4

Figure 13:
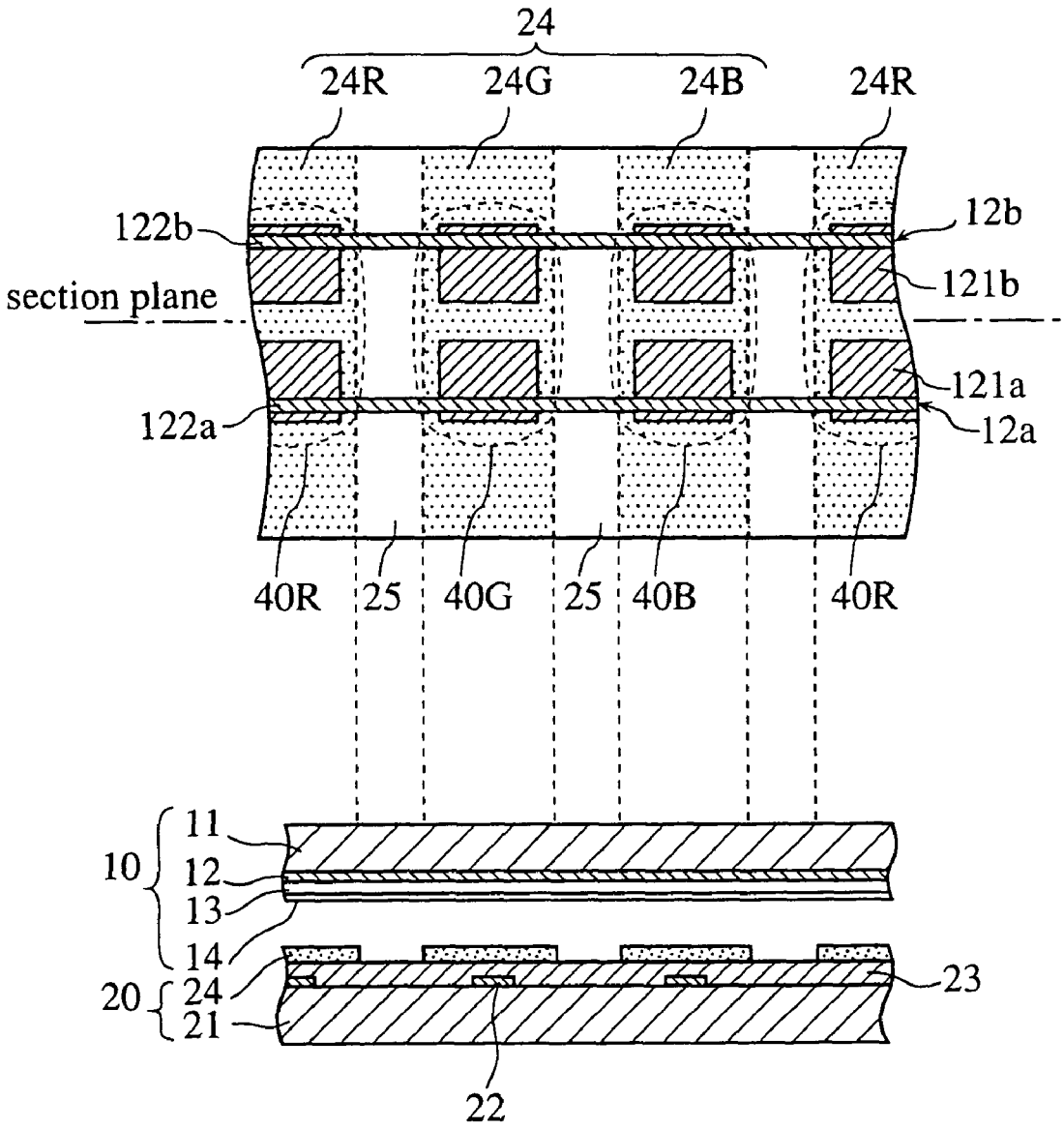
FIG. 13 is an abbreviated partial cross-section of the gas discharge panel according to the fourth embodiment.

FIG. 13 shows an abbreviated partial cross-section of a gas discharge panel according to this embodiment. The following is an explanation of the structure of such a gas discharge panel with reference to this figure.

A gas discharge panel of this embodiment has discharge gas filled to near atmospheric pressure (in the vicinity of 760 Torr to 1013 Torr), and in principle does not use gap members, but is otherwise similar in configuration to the gas discharge panel described by FIG. 1 above.

As described above, conventional gas discharge panels contain discharge gas at much lower than atmospheric pressure, meaning that without a dense structure of barrier ribs or gap members in the display area, the space between the front and back panels cannot be properly maintained.

However, this embodiment sets discharge gas pressure in proximity to atmospheric pressure, maintaining a balance between internal and external gas pressure. Therefore, the space between the front and back panels can be properly maintained without a dense structure of barrier ribs or gap members in the display area, or without any barrier ribs or gap members in the display area at all.

Here, it is desirable to set the filling pressure in a range of 80% to 120% of atmospheric pressure, matched to the atmospheric pressure of the location of use.

The type of gas discharge panel here eliminates the process of placing gap members o the substrate, and has filling pressure of the discharge gas set at near atmospheric pressure, but otherwise can be produced in the same manner as Example 1 above. However, it is necessary to maintain the space between the two substrates during the sealing process, using a method such as placing gap members around the periphery of the substrates.

In addition, this type of gas discharge panel may be produced using beads of a material such as plastic which is destroyed by heat. For example, this type of gas discharge panel may be produced using the production method of Example 1 above, by substituting beads of a material decomposed by heat for the glass beads and setting discharge gas filling pressure to near atmospheric pressure.

As described here, according to this embodiment, it is not necessary to form barrier ribs, nor are gap members necessary in principle, so that it is possible to produce a gas discharge panel even more simply than by the methods of Embodiments 1 and 2.

Embodiment 5

Figure 14:
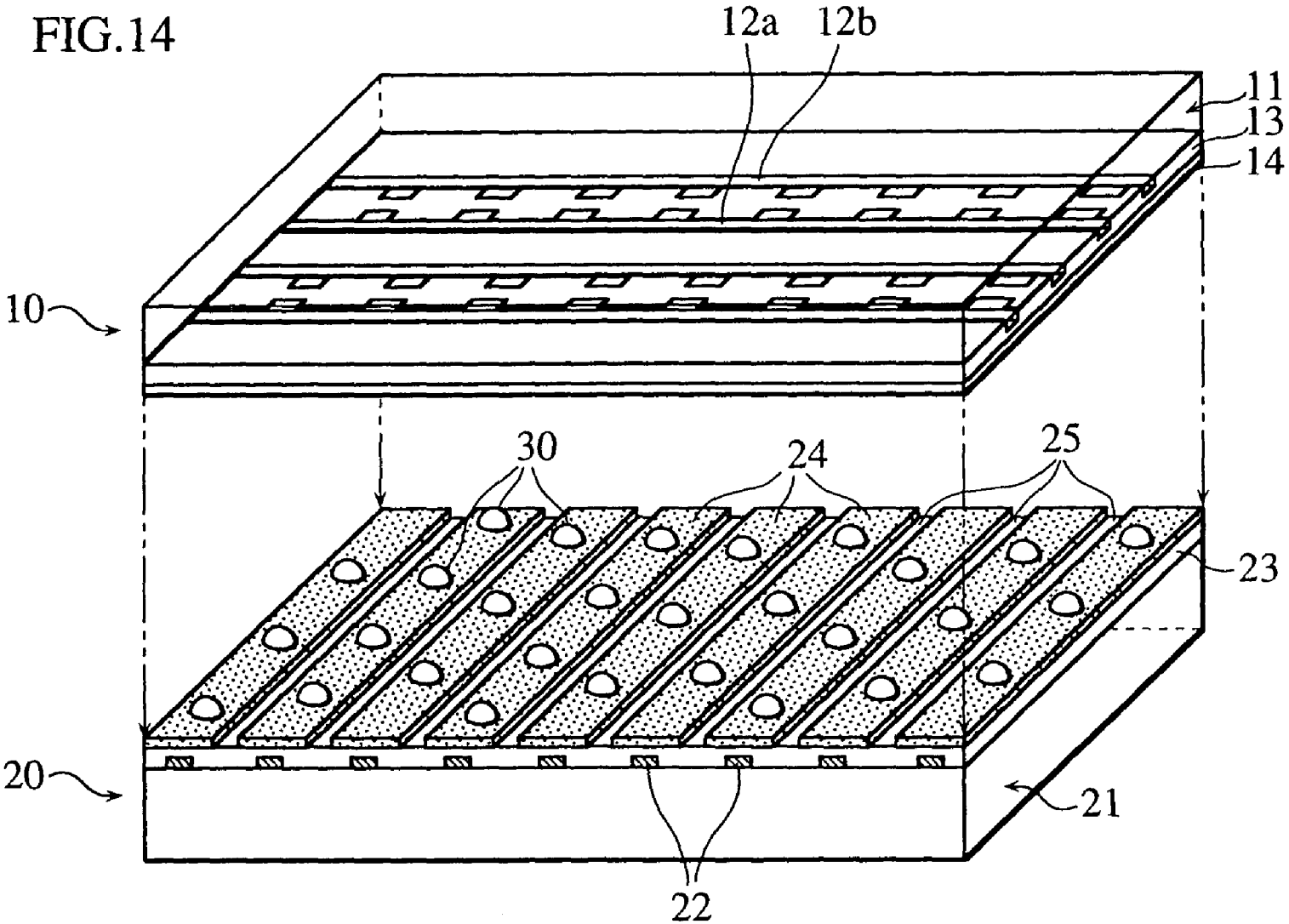
FIG. 14 is an isometric exploded view of a gas discharge panel according to the fifth embodiment.
Figure 15:
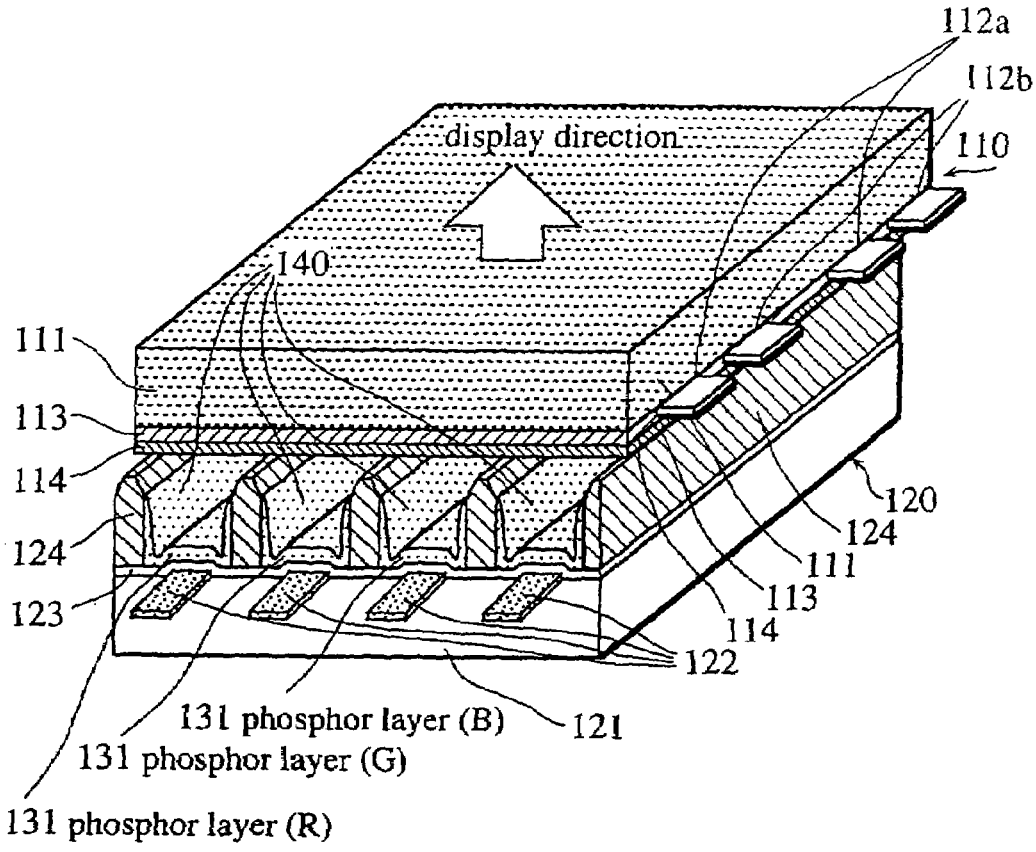
FIG.15 PRIOR ART
FIG. 15 shows a typical example of an AC plane gas discharge panel.
Figure 16A:
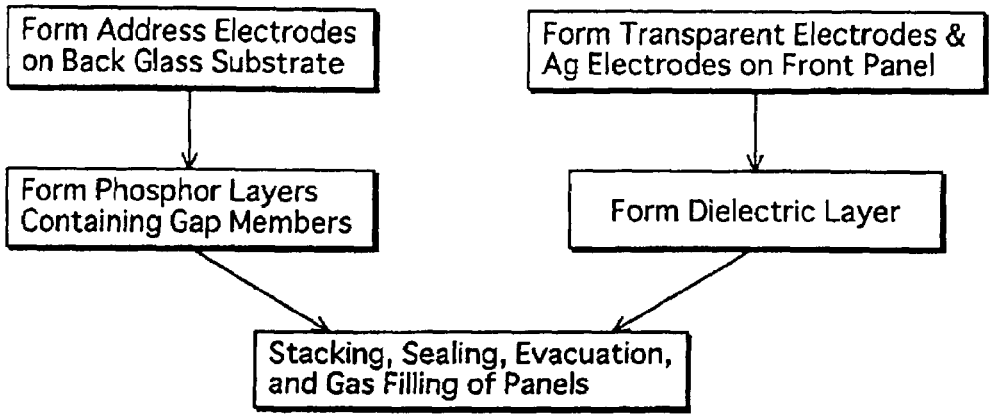
FIG. 16*a* is a flowchart showing a production method for making a gas discharge panel according to the present invention.
Figure 16B:
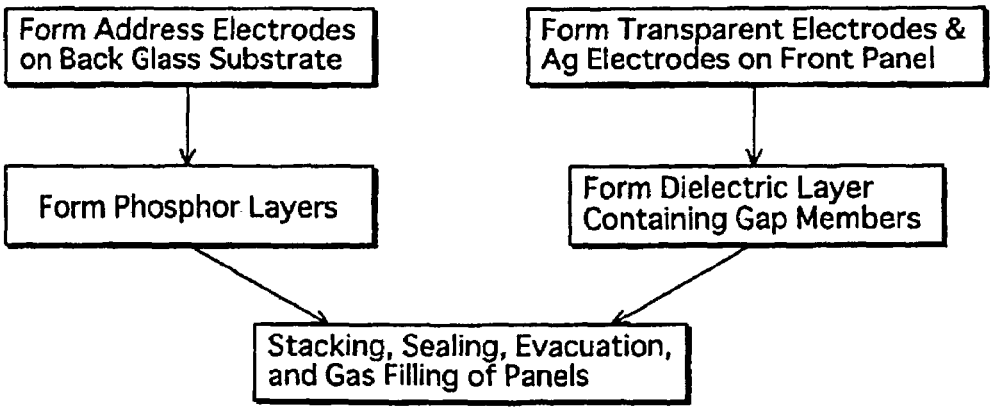
FIG. 16*b* is a flowchart showing a production method for making a gas discharge panel according to the present invention.

FIG. 14 shows an exploded isometric view of a gas discharge panel according to this embodiment.

This gas discharge panel is similar to the gas discharge panel 1 described in Embodiment 1, but instead of locating gap members 30 in the blank areas 25, gap members 30 are distributed across the phosphor layers 24R, 24G, 24B.

This type of gas discharge panel may be produced by the following method.

As described in FIG. 6(*a*) of Example 1, address electrodes 22 are formed on the back glass substrate 21, and a back dielectric layer 23 is formed covering them.

Next, phosphor layers are formed using a photosensitive phosphor film in each color, but gap members 30, glass beads, are fixed in the film in advance.

Then, green phosphor film is applied across the entire surface of the back dielectric layer 23, and the film is patterned in a line form by exposure to light. Next, red film and blue film are applied and patterned in similar fashion.

Then, this assembly is baked to form red, green and blue phosphor layers 24R, 24G, 24B. Thus, the back panel 20 shown in FIG. 14 is produced.

Next, a front panel 10 is situated on top of the back panel, which has gap members 30 placed on it, the edges of the panels are sealed with sealing material and discharge gas is filled, completing the gas discharge panel.

The gas discharge panel of this embodiment has gap members 30 on the phosphor layers 24R, 24G, 24B, and in the center area of the discharge cells, creating a greater tendency towards discharge failure than in Embodiments 1 through 4 above, but the space between the front and back panels 10, 20 can be precisely maintained. Also, since gap members 30 are placed in the process of forming the phosphor layers, it is not necessary to form gap members in a separate step as in Embodiments 1 through 3, creating an advantage in ease of production.

Modification Example of this Embodiment

Instead of including gap members 30 in the phosphor layers 24 as above, gap members 30 (glass beads) may be included in the dielectric layer 13.

In this case, by distributing gap members 30 in the dielectric paste while forming the dielectric layer 13, a similar production method and similar results can be achieved.

Miscellaneous

Embodiments 1 through 5 above used a surface discharge type gas discharge panel as an example for explanatory purposes, but for an opposed discharge type gas discharge panel also, by arranging the front and back panels such that sustaining electrode pairs intersect each other, a gas discharge panel with gap members that displays color images can be created in similar fashion to the plane-discharge type gas discharge panel described above.

Here, an opposed discharge type gas discharge panel has front and back panels situated such that sustaining electrode pairs intersect each other, so that sustaining discharge occurs centered at the intersections. However, as described in Embodiment 1, by forming protrusions in the sustaining electrodes where the pairs intersect, or by adjusting the shape of the dielectric layer or the protective layer, discharge can be more reliably concentrated in the center areas of the discharge cells.

INDUSTRIAL APPLICABILITY

The gas discharge panel and method of gas discharge panel production of the present invention are suited for use in color display devices, especially large-format color display devices, such as those used in computers and televisions.

What is claimed is:

1. A gas discharge panel, which comprises (a) a first substrate and a second substrate facing each other across an interval, the interval forming a discharge space and being filled with discharge gas, (b) pairs of electrodes for sustaining discharge provided on at least one of the substrates, (c) a plurality of discharge cells formed in a pattern along the electrode pairs, and (d) a plurality of phosphor layers formed by baking a phosphor film and provided on the first substrate facing the discharge cells, each phosphor layer corresponding to an illumination color of the discharge cell, and the gas discharge panel displaying a color image by selectively illuminating the discharge cells, wherein a plurality of gap members having a spherical shape are disposed at locations corresponding to boundary areas between and excluding the center areas of the discharge cells, so as to separate the first substrate and second substrate, and determine the interval between the first substrate and second substrate.

2. The gas discharge panel of claim 1, wherein the electrode pairs and their surrounding structures are provided such that, when a voltage is applied to the electrode pairs and sustaining discharge is caused, discharge primarily occurs in the center of the discharge cells, rather than near the boundaries.

3. The gas discharge panel of claim 2, wherein each electrode pair is covered with a dielectric layer in an area toward the discharge space, and the dielectric layer is covered with a layer of magnesium oxide in an area toward the center of the discharge cell and excluding the boundary area.

4. The gas discharge panel of claim 2, wherein the second substrate has a black matrix formed in areas corresponding to boundary areas.

5. The gas discharge panel of claim 2, wherein the phosphor layers are thinner towards the boundaries than in the center areas.

6. The gas discharge panel of claim 2, wherein the electrode pairs comprise a plurality of linear electrodes, provided in a stripe pattern on the second substrate, and an interval between the linear electrodes forming the pairs is smaller in the center of the discharge cells than toward the boundaries of the discharge cells.

7. The gas discharge panel of claim 6, wherein the second substrate has a black matrix formed in areas corresponding to boundary areas.

8. The gas discharge panel of claim 6, wherein the phosphor layers are thinner towards the boundaries than in the center areas.

9. The gas discharge panel of claim 2, wherein each electrode pair has a transparent electrode, and the transparent electrode has a shape such that an interval between the linear electrodes forming the pair is smaller in the center of the discharge cell than toward the boundaries of the discharge cell.

10. The gas discharge panel of claim 9, wherein the second substrate has a black matrix formed in areas corresponding to boundary areas.

11. The gas discharge panel of claim 9, wherein the phosphor layers are thinner towards the boundaries than in the center areas.

12. The gas discharge panel of claim 2, wherein each electrode pair is covered with a dielectric layer in an area toward the discharge space, and the dielectric layer has a thickness which is smaller in the center of the discharge cell than toward the boundaries of the discharge cell.

13. The gas discharge panel of claim 12, wherein the second substrate has a black matrix formed in areas corresponding to boundary areas.

14. The gas discharge panel of claim 1, wherein the second substrate has a black matrix formed in areas corresponding to boundary areas.

15. The gas discharge panel of claim 1, wherein the phosphor layers are thinner towards the boundaries than in the center areas.

16. The gas discharge panel of claim 15, wherein a dielectric layer is provided on the first substrate, the phosphor layers are provided on the dielectric layer, and the gap members are partially buried in the dielectric layer.

17. The gas discharge panel of claim 15, wherein the electrode pairs comprise a plurality of linear electrodes, provided in a stripe pattern on the second substrate, and the phosphor layers are provided in a stripe pattern in a direction which intersects with the electrode pairs.

18. The gas discharge panel of claim 1, wherein a dielectric layer is provided on the second substrate, and the gap members are partially buried in the dielectric layer.

19. The gas discharge panel of claim 1, wherein a phosphor element is applied to their surfaces of the gap members.

20. The gas discharge panel of claim 1, wherein the gap members have a spherical or rod-like shape.

21. The gas discharge panel of claim 1, wherein the gap members are in contact with at least one of the first substrate and second substrate.

22. A gas discharge panel display device, which displays an image by selectively illuminating the plurality of discharge cells, comprising:

the gas discharge panel of claim 1, and a driving unit, which applies a voltage to the electrode pairs for sustaining discharge.

23. A method for production of a gas discharge panel, the panel having discharge cells of each color arranged in a matrix pattern formed between a first substrate and a second substrate, the production method comprising:

a phosphor layer forming process, for providing a phosphor layer corresponding to an illumination color of each discharge cell on the first substrate, a gap member distribution process, for disposing gap members having a spherical shap e at locations on the first substrate or the second substrate corresponding to boundaries between discharge cells, and a stacking process, for joining the first substrate and the second substrate after gap members have been applied to one of the substrates.

24. The gas discharge panel production method of claim 23, wherein the gap member distribution process includes:

an adhesive layer forming step, for providing an adhesive layer in areas of the first substrate or the second substrate corresponding to the boundaries, and a gap member distribution step, for spreading gap members over the adhesive layer.

25. The gas discharge panel production method of claim 24, wherein the gap member distribution process includes, after the gap member distribution step, a removal step, for removing the gap members located in areas of the first substrate or the second substrate other than on the adhesive layer.

26. The gas discharge panel production method of claim 24, wherein in the removal step, gap members are removed by blowing gas over or by agitating the substrate to which gap members were applied.

27. A method for production of a gas discharge panel, comprising:

an electrode forming process, for forming electrodes on a first substrate, a dielectric element material application process, for applying a dielectric element material to cover the electrodes, the dielectric element material containing gap members situated in contact with the first substrate and the second substrate, thereby determining an interval between the first substrate and the second substrate, a dielectric element baking process, for baking the applied dielectric element, and after, the dielectric element material application process, a stacking process, for joining the first substrate to a second substrate.

* * * * *

UNITED STATES PATENT AND TRADEMARK OFFICE

CERTIFICATE OF CORRECTION

PATENT NO. : 7,023,136 B2
APPLICATION NO. : 10/621023
DATED : April 4, 2006
INVENTOR(S) : Junichi Hibino et al.

It is certified that error appears in the above-identified patent and that said Letters Patent is hereby corrected as shown below:

In the Claims:

In Claim 23, Column 17, line 5, “shap e” should be one word: --shape--

In Claim 27, Column 18, line 19, the comma [,] after “after” should be deleted.

Signed and Sealed this

Twenty-fifth Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 7,023,136 B2
APPLICATION NO. : 10/621023
DATED : April 4, 2006
INVENTOR(S) : Junichi Hibino et al.

It is certified that error appears in the above-identified patent and that said Letters Patent is hereby corrected as shown below:

TITLE PAGE, ITEM (75)Inventors: Junichi Hibino, Neyagawa (JP), Yoshiki Sasaki, Shijounawate (JP) --, Katuyoshi Yamashita, Katano (JP), Masafumi Ookawa, Neyagawa (JP), and Tetsuo Hori, Kawachinagano (JP)-- is added.

Signed and Sealed this

Twenty-third Day of October, 2007

JON W. DUDAS
*Director of the United States Patent and Trademark Office*